US007296879B2

(12) United States Patent
Fukunaga et al.

(10) Patent No.: US 7,296,879 B2
(45) Date of Patent: Nov. 20, 2007

(54) LIQUID EJECTION HEAD AND METHOD OF PRODUCING THE SAME

(75) Inventors: Toshiaki Fukunaga, Kanagawa (JP); Yasuhisa Kaneko, Kanagawa (JP)

(73) Assignee: FUJIFILM Corporation, Tokyo (JP)

( * ) Notice: Subject to any disclaimer, the term of this patent is extended or adjusted under 35 U.S.C. 154(b) by 376 days.

(21) Appl. No.: 11/061,575

(22) Filed: Feb. 22, 2005

(65) Prior Publication Data

US 2005/0185020 A1 Aug. 25, 2005

(30) Foreign Application Priority Data

Feb. 25, 2004 (JP) ..... 2004-049344
Feb. 26, 2004 (JP) ..... 2004-051774

(51) Int. Cl.
*B41J 2/04* (2006.01)

(52) U.S. Cl. ..... 347/54; 347/55

(58) Field of Classification Search ..... 347/54, 347/55, 73–76, 111, 123, 127, 103, 154, 159, 347/128, 141, 151
See application file for complete search history.

(56) References Cited

U.S. PATENT DOCUMENTS 5,835,113 A 11/1998 Hirahara et al. ..... 347/55
6,092,889 A * 7/2000 Nakamoto et al. ..... 347/55
6,158,844 A * 12/2000 Murakami et al. ..... 347/55

FOREIGN PATENT DOCUMENTS

| | | |
|---|---|---|
| JP | 8-149253 A | 6/1996 |
| JP | 9-309208 A | 12/1997 |
| JP | 10-76664 A | 3/1998 |
| JP | 10-230608 A | 9/1998 |
| JP | 11-105293 A | 4/1999 |

* cited by examiner

*Primary Examiner*—Juanita D. Stephens
(74) *Attorney, Agent, or Firm*—Sughrue Mion Pllc.

(57) ABSTRACT

The liquid ejection head ejects droplets by causing an electrostatic force to act on a solution in which charged particles are dispersed. The head includes a solution guide mounted at a position corresponding to a through-hole on a first surface of an insulating head substrate on a through-hole substrate side and gradually narrowing toward a tip end portion, the tip end portion thereof passing through and protruding from the through-hole, a control electrode provided on the first surface of the head substrate so that a center thereof approximately coincides with the solution guide, a electrode drawing portion connected to the control electrode and passing through the head substrate and a wiring portion provided on a second surface being a back side of the head substrate and connecting to each other the electrode drawing portion and means for applying a voltage to the control electrode.

18 Claims, 25 Drawing Sheets

LIQUID EJECTION HEAD AND METHOD OF PRODUCING THE SAME

This application claims priority on Japanese patent applications No. 2004-44416, No. 2004-49344 and No. 2004-51774, the entire contents of which are hereby incorporated by reference.

BACKGROUND OF THE INVENTION

The present invention relates to a liquid ejection head that ejects a droplet by causing an electrostatic force to act on a solution in which charged particles are dispersed, and a method of producing the same.

Nowadays, a thermal-type ink jet head that ejects an ink droplet by means of an expansive force of an air bubble generated in ink through heating of the ink and a piezoelectric-type ink jet head that ejects an ink droplet by giving a pressure to ink using a piezoelectric element have been proposed as liquid ejection heads. In the thermal-type ink jet head, however, the ink is partially heated to 300° C. or higher, and a problem arises in that a material for the ink is limited. Also, when using the piezoelectric-type ink jet head, there occurs a problem in that its structure is complicated and an increase in cost is inevitable.

As a liquid ejection head that solves the problems described above, a system is proposed which uses ink containing a charged fine particle component and controls ejection of the ink by utilizing an electrostatic force through application of a predetermined voltage to each control electrode of the ink jet head in accordance with image data, thereby recording an image corresponding to the image data on a recording medium.

Various ink jet recording apparatuses adopting the electrostatic ink jet recording system are known (see JP 10-230608 A, JP 09-309208 A, JP 10-76664 A, JP 11-105293 A, and JP 08-149253 A, for instance).

FIG. 25 is a conceptual diagram schematically showing an example of an outline construction of an ink jet head of an ink jet recording apparatus disclosed in JP 10-230608 A. This drawing conceptually shows the periphery of one ink guide serving as an ink ejection position of the ink jet head disclosed therein. An ink jet head 400 shown in FIG. 25 includes a head substrate 402, an ink guide 404, an electrical insulating substrate 406, a control electrode 408, a counter electrode 410 supporting a recording medium P, a bias voltage supply 412, and a signal voltage supply 414.

The ink guide 404 has a convex tip end portion 404*a* including an ink guide groove 420 obtained through cutting by a predetermined width and is arranged on the head substrate 402. Also, in the insulating substrate 406, a through-hole (ejection opening) 418 is established at a position corresponding to arrangement of the ink guide 404. The ink guide 404 passes through the through-hole 418 and protrudes upwardly from a surface of the insulating substrate 406 on a recording medium P side. In addition, the head substrate 402 and the insulating substrate 406 are arranged so as to be spaced apart from each other by a predetermined distance and a gap between these substrates 402 and 406 is defined as a flow path 416 of ink Q.

The control electrode 408 is provided in a ring manner for each through-hole 418 on the surface of the insulating substrate 406 on the recording medium P side so as to surround the periphery of the through-hole 418. Also, the control electrode 408 is connected to the signal voltage supply 414 that generates a pulse voltage in accordance with image data, and the signal voltage supply 414 is grounded through the bias voltage supply 412.

In addition, the counter electrode 410 is arranged so as to be opposed to the tip end portion 404*a* of the ink guide 404 and is grounded. The recording medium P is arranged on a surface of the counter electrode 410 on an ink guide 404 side. That is, the counter electrode 410 functions as a platen that supports the recording medium P.

At the time of recording, the ink Q containing colorant particles charged to the same polarity as a voltage applied to the control electrode 408 is circulated by an ink circulation mechanism (not shown) in the ink flow path 416 in a direction from the right side to the left side in FIG. 25. Also, a high voltage of 1.5 kV for example is applied to the control electrode 408 by the bias voltage supply 412. At this time, a part of the ink Q in the ink flow path 416 is supplied to the tip end portion 404*a* while passing through the ink guide groove 420 by a capillary phenomenon, surface tension, surface wetting, or the like.

Here, a DC voltage of 1.5 kV for example is applied to the control electrode 408 from the bias voltage supply 412 as a constant bias. When a pulse voltage of 500 V for example is applied from the signal voltage supply 414 to the control electrode 408 biased to the DC 1.5 kV as a signal voltage corresponding to an image signal, an ink droplet whose main ingredient is the colorant component, flies out from the tip end portion 404*a* of the ink guide 404, is attracted by the counter electrode 410, and adheres onto the recording medium P, thereby forming a dot of an image.

As a method of producing such an ink jet head, JP 10-230608 A discloses production of the ink guide through plastic molding.

Also, JP 09-309208 A discloses an ink jet head where no ink guide is provided, a meniscus having an approximately hemispherical shape is formed at an ink outflow opening by means of the pressure of ink flowing out from an ink supply path and the surface tension of the ink, and an ink droplet is ejected by utilizing an electrostatic force.

Also, JP 10-76664 A discloses an image forming apparatus that is capable of performing high-speed drawing using a system that includes accommodation means for accommodating a recording liquid obtained by dispersing charged colorant particles in an insulating liquid, an ink flow path which has an opening arranged at a position spaced apart from an image formation target medium by a predetermined distance and in which the recording liquid is circulated, a first electrode provided in the ink flow path, a second electrode that is provided in the ink flow path so as to be opposed to the first electrode and has a tip end that extends until approximately the same height as the opening, supply means for supplying the recording liquid accommodated in the accommodation means to the opening, and voltage application means for applying voltages to the first and second electrodes in accordance with a predetermined image signal to thereby cause the colorant particles in the recording liquid supplied to the vicinity of the opening to gather and cause the gathering colorant particles to be separated and ejected from the insulating liquid for formation of an image on the image formation target medium.

JP 11-105293 A discloses an ink jet head where like in the case of JP 10-76664 A, ink is caused to flow along a protrusion portion that is an ink guide member and a meniscus is formed at a protrusion of the protrusion plate. This protrusion is obtained by molding an alumina-made electrode base and sharpening a tip end thereof through grinding.

Further, in FIG. 12 of JP 08-149253 A, an ejection head is disclosed in which a conical protrusion that is thick at its base portion and narrows as the distance to the tip end thereof decreases is provided and the surfaces of the protrusion and an individual electrode are continuously covered with a conductive substance. Also, in FIG. 17 of this patent document, as a method of producing the conical protrusion, machining of Si or conductive Si with a semiconductor process is disclosed.

By the way, in the ink jet head disclosed in JP 10-230608 A, the ink is caused to move upwardly until a sharply pointed portion by utilizing a capillary phenomenon. Therefore, there is a problem in that ink supply takes a long period of time and ink droplets having a stabilized size and colorant particle concentration cannot be successively ejected at a high ejection frequency.

As described above, it is impossible to increase the ejection frequency of ink droplets. There is a shortcoming in that high-speed drawing cannot be performed.

Also, in the case of the ink jet head disclosed in JP 09-309208 A, the ejection opening needs to have a hole diameter with which clogging will not occur. Therefore, there is a problem in that it is difficult to cause a minute droplet to fly and a high voltage is required to cause droplet flying.

Further, in the case of the ink jet heads disclosed in JP 10-76664 A and JP 11-105293 A, it is difficult to obtain a two-dimensionally arrayed head structure. There is a problem in that ejection portions cannot be arranged at a high density and it is difficult to record a high-quality image at high speed. Still further, when the ink jet head disclosed in JP 11-105293 A is a line head where it is required to form nozzles at a high density, interferences between the nozzles occur and it is impossible to control the diameters of ink droplets. There is also a problem in that it is difficult to record a high-quality image.

Further, in the ink jet head disclosed in JP 08-149253 A, wiring exists in the flow path. Therefore, there is a problem in that electric field interferences occur and it is difficult to control ejection concentrations between channels.

SUMMARY OF THE INVENTION

The present invention has been made in order to solve the problems of the conventional techniques described above and has an object to provide a liquid ejection head that is capable of forming a high-quality recorded image at high speed by causing ink droplets to be ejected/fly with stability through low-voltage driving and a liquid ejection head production method which makes it possible to produce the liquid ejection head with high accuracy while achieving high productivity.

Here, in order to attain the object described above, the inventors of the present invention repeatedly conducted earnest studies on the electrostatic liquid ejection head and found as a result of the studies that in the electrostatic liquid ejection head to be provided with the present invention, it is required to record a high-quality image at high speed and a low voltage with stability and that in order to record a high-quality image at high speed and a low voltage with stability using the electrostatic liquid ejection head, it is required to form sharply pointed portions provided at the tip ends of ink guide members serving as droplet ejection positions at a high density and with high definition. Based on the findings, the inventors have made the present invention.

More specifically, according to a first aspect of the present invention, there is provided a liquid ejection head that ejects droplets by causing an electrostatic force to act on a solution in which charged particles are dispersed, including: a through-hole substrate in which at least one through-hole, through which the droplets are ejected, is formed; an electrical insulating head substrate arranged to be spaced apart from the through-hole substrate by a predetermined distance, wherein a gap between the through-hole substrate and the electrical insulating head substrate being defined as a flow path of the solution; at least one solution guide, each being mounted at each position corresponding to each through-hole on a first surface of the electrical insulating head substrate on a through-hole substrate side, a tip end portion of each solution guide passing through and protruding from each through-hole, and each solution guide gradually narrowing toward the tip end portion; at least one control electrode, each being provided on the first surface of the electrical insulating head substrate so that a center of each control electrode approximately coincides with each solution guide and causing the electrostatic force to act on the solution; at least one electrode drawing portion, each being connected to each control electrode and passing through the electrical insulating head substrate from the first surface to a second surface on a back side opposite to the first surface; and a wiring portion provided on the second surface of the electrical insulating head substrate and connecting to each other the at least one electrode drawing portion and voltage application means for applying a voltage to the at least one control electrode.

According to a second aspect of the present invention, the at least one solution guide is preferably a metal-made solution guide having a sharply pointed tip end portion.

To be more specific, according to the second aspect of the present invention, a liquid ejection head that ejects droplets by causing an electrostatic force to act on a solution in which charged particles are dispersed, includes: a through-hole substrate in which at least one through-hole, through which the droplets are ejected, is formed; an electrical insulating head substrate arranged to be spaced apart from the through-hole substrate by a predetermined distance, wherein a gap between the through-hole substrate and the electrical insulating head substrate being defined as a flow path of the solution; at least one solution guide, each being mounted at each position corresponding to each through-hole on a first surface of the electrical insulating head substrate on a through-hole substrate side, a tip end portion of each solution guide passing through and protruding from each through-hole, and each solution guide gradually narrowing toward the tip end portion, thus being a metal-made solution guide having the sharply pointed tip end portion; at least one control electrode, each being provided on the first surface of the electrical insulating head substrate so that a center of each control electrode approximately coincides with each solution guide and causing the electrostatic force to act on the solution; at least one electrode drawing portion, each being connected to each control electrode and passing through the electrical insulating head substrate from the first surface to a second surface on a back side opposite to the first surface; and a wiring portion provided on the second surface of the electrical insulating head substrate and connecting to each other the at least one electrode drawing portion and voltage application means for applying a voltage to the at least one control electrode.

According to the first and second aspects of the present invention, each control electrode is preferably provided on the first surface of the electrical insulating head substrate around a base portion of each solution guide so as to surround each solution guide and be spaced apart from each solution guide by a predetermined distance.

According to the first aspect of the present invention, the tip end portion of the at least one solution guide preferably has at least one of a tip end angle of 60° or less and a radius of curvature of 4 μm or less.

According to the second aspect of the present invention, the at least one solution guide is preferably insulated, and the at least one solution guide is preferably mounted onto an insulation layer attached onto a metallic layer attached onto the first surface of the electrical insulating head substrate.

The tip end portion of the at least one solution guide preferably has at least one of a tip end angle of 120° or less and a radius of curvature of 4 μm or less.

According to the first and second aspects of the present invention, the at least one control electrode is preferably partially removed on an upstream side of the flow path from which the solution is supplied.

Furthers the at least one electrode drawing portion is preferably provided on a downstream side of the flow path that is a side opposite to a solution supply side of the flow path with respect to the at least one solution guide.

According to a third aspect of the present invention, it is preferred that each control electrode be provided at each position corresponding to each through-hole on the first surface of the electrical insulating head substrate and that each solution guide be mounted onto each control electrode.

To be more specific, according to the third aspect of the present invention, a liquid ejection head that ejects droplets by causing an electrostatic force to act on a solution in which charged particles are dispersed, includes: a through-hole substrate in which at least one through-hole, through which the droplets are ejected, is formed; an electrical insulating head substrate arranged to be spaced apart from the through-hole substrate by a predetermined distance, wherein a gap between the through-hole substrate and the electrical insulating head substrate being defined as a flow path of the solution; at least one solution guide, each being mounted onto each control electrode, a tip end portion of each solution guide passing through and protruding from each through-hole, and each solution guide gradually narrowing toward the tip end portion; at least one control electrode, each being provided at each position corresponding to each through-hole on the first surface of the electrical insulating head substrate and causing the electrostatic force to act on the solution; at least one electrode drawing portion, each being connected to each control electrode and passing through the electrical insulating head substrate from the first surface to a second surface on a back side opposite to the first surface; and a wiring portion provided on the second surface of the electrical insulating head substrate and connecting to each other the at least one electrode drawing portion and voltage application means for applying a voltage to the at least one control electrode.

According to the third aspect, the tip end portion of the at least one solution guide preferably has at least one of a tip end angle of 60° or less and a radius of curvature of 4 μm or less.

The at least one solution guide preferably has conductivity.

The at least one solution guide is preferably made of a semiconductor whose electric conductivity is in a range of from $10^{-2}$ S/m to $10^{6}$ S/m.

The at least one solution guide is preferably made of Si.

According to the first, second and third aspects of the present invention, it is preferred that the through-hole substrate be insulative and that the liquid ejection head further include a shield electrode with which the through-hole substrate is provided.

A surface of the through-hole substrate on a side opposite to an electrical insulating head substrate side is preferably liquid-repellent.

Preferably, the liquid ejection head further includes at least one flow path weir arranged for the electrical insulating head substrate outside the at least one solution guide, the at least one control electrode and the at least one electrode drawing portion.

According to a fourth aspect of the present invention, there is provided a method for producing a liquid ejection head that ejects droplets by causing an electrostatic force to act on a solution in which charged particles are dispersed, including: forming a wiring portion by forming a first metallic film on a first surface of an electrical insulating substrate and patterning the thus formed first metallic film; forming at least one convex portion through etching for a second surface opposite to the first surface of the electrical insulating substrate on which the wiring portion is formed; forming at least one control electrode for causing the electrostatic force to act on the solution, in a peripheral region of the at least one convex portion of the electrical insulating substrate to correspond to the wiring portion; forming at least one through-hole, which passes through the electrical insulating substrate from the first surface to the second surface, so that parts of the wiring portion and each control electrode form parts of an inner wall of each through-hole; forming at least one electrode drawing portion for connecting the wiring portion and each control electrode to each other, by forming a second metallic film on a side wall surface of each through-hole and filling each through-hole with a metal; joining the at least one convex portion and a single crystal substrate to each other; and forming at least one solution guide where at least a tip end portion thereof is sharply pointed for the at least one convex portion by performing at least anisotropic etching of the single crystal substrate.

According to a first embodiment of the fourth aspect of the present invention, the forming step of the at least one solution guide preferably includes: forming the sharply pointed tip end portion of the at least one solution guide by forming a first mask for the single crystal substrate and anisotropically etching the single crystal substrate until the first mask is separated from the single crystal substrate; and forming a columnar base portion of the at least one solution guide on the at least one convex portion by forming a second mask for the tip end portion and etching the single crystal substrate.

According to a second embodiment of the fourth aspect of the present invention, the forming step of the at least one solution guide is preferably a forming step of at least one solution guide whose tip end is composed of one of a sharply pointed cone and a sharply pointed pyramid on the at least one convex portion through anisotropic etching of the single crystal substrate.

According to a fifth aspect of the present invention, there is provided a method for producing a liquid ejection head that ejects droplets by causing an electrostatic force to act on a solution in which charged particles are dispersed, including: forming a wiring portion by forming a first metallic film on a first surface of an electrical insulating substrate and patterning the thus formed first metallic film; forming at least one control electrode for causing the electrostatic force to act on the solution, to correspond to the wiring portion by forming a second metallic film on a second surface of the insulating substrate and patterning the thus formed second metallic film;

forming at least one through-hole, each of which passes through the electrical insulating substrate from the first surface to the second surface, so that parts of the wiring portion and each control electrode form parts of an inner wall of each through-hole; forming at least one electrode drawing portion for connecting the wiring portion and each control electrode to each other, by forming a third metallic film on a side wall surface of each through-hole and filling each through-hole with a metal; forming at least one concave portion whose depth gradually increases toward a center thereof on a single crystal substrate, by forming a mask having an opening on a surface of the single crystal substrate and performing anisotropic etching on the single crystal substrate; forming at least one metal portion serving as a solution guide by filling the at least one concave portion of the single crystal substrate with a metal; forming at least one electrical insulation layer portion on a surface of the at least one metal portion of the single crystal substrate, respectively; forming at least one metallic layer portion on a surface of the at least one electrical insulation layer portion of the single crystal substrate, respectively; joining a surface of the at least one metallic layer portion of the single crystal substrate and the second surface of the electrical insulating substrate to each other so that a center of each metallic layer portion of the single crystal substrate approximately coincides with a center of each control electrode of the electrical insulating substrate; and forming at least one solution guide for the second surface of the electrical insulating substrate by removing the single crystal substrate.

According to a sixth aspect of the present invention, there is provided a method for producing a liquid ejection head that ejects droplets by causing an electrostatic force to act on a solution in which charged particles are dispersed, including: forming a wiring portion by forming a first metallic film on a first surface of an electrical insulating substrate and patterning the thus formed first metallic film; forming at least one control electrode for causing the electrostatic force to act on the solution, to correspond to the wiring portion by forming a second metallic film on a second surface opposite to the first surface of the electrical insulating substrate on which the wiring portion is formed and patterning the thus formed second metallic film; forming at least one through-hole, each of which passes through the electrical insulating substrate from the first surface to the second surface, so that parts of the wiring portion and each control electrode form parts of an inner wall surface of each through-hole; forming at least one electrode drawing portion for connecting the wiring portion and the at least one control electrode to each other, by forming a third metallic film on a side wall surface of each through-hole and filling each through-hole with a metal; joining the at least one control electrode and a single crystal substrate to each other; and forming at least one solution guide where at least a tip end portion thereof is sharply pointed on the at least one control electrode by performing at least anisotropic etching of the single crystal substrate.

According to a first embodiment of the sixth aspect of the present invention, the forming step of the at least one solution guide preferably includes: forming the sharply pointed tip end portion of the at least one solution guide by forming a first mask for the single crystal substrate and anisotropically etching the single crystal substrate until the first mask is separated from the single crystal substrate; and forming a columnar base portion of the at least one solution guide on the at least one control electrode by forming a second mask for the tip end portion and etching the single crystal substrate.

According to a second embodiment of the sixth aspect of the present invention, the forming step of the at least one solution guide is preferably a forming step of at least one solution guide whose tip end is composed of one of a sharply pointed cone and a sharply pointed pyramid on the at least one control electrode through anisotropic etching of the single crystal substrate.

With the liquid ejection heads according to the first to third aspects of the present invention, in particular, with the construction according to the second aspect, in which the metal-made ink guide provided on the electrical insulating head substrate and having a sharply pointed tip end is combined with the control electrode, and with the construction according to the third aspect where the ejection electrode is provided on the head substrate and a solution guide having a sharply pointed tip end is provided on the ejection electrode, an electric field can concentrate at the tip end portion of the solution guide. Therefore, it is possible to reduce a pulse voltage necessary for ejection and use an inexpensive IC (control circuit) having a low withstand voltage. As a result, it becomes possible to miniaturize/stabilize the liquid ejection head.

Also, according to the first to third aspects of the present invention, it becomes possible to supply the charged particles up to the vicinity of the tip end portion of the solution guide and perform high-speed drawing. In addition, electric field interferences do not occur between electrodes, and the sizes of ejected ink droplets are stabilized.

Further, according to the first to third aspects of the present invention, a distance between the tip end portion of each solution guide and its corresponding control electrode can be set constant, thereby uniformizing an electric field formed by the tip end portion of the solution guide of each ejection portion and stabilizing the ejection.

Still further, according to the first to third aspects of the present invention, the wiring portion is provided on the back surface of the head substrate, thereby uniformizing the electric field formed at each ejection portion and suitably ejecting droplets.

Also, with the liquid ejection head production methods according to the second to fourth aspects of the present invention, a liquid ejection head including an ink guide having high reliability and high accuracy can be produced at a low cost.

DESCRIPTION OF THE PREFERRED EMBODIMENTS

A liquid ejection head and a production method thereof according to the present invention will now be described in detail based on preferred embodiments illustrated in the accompanying drawings.

First, a liquid ejection head according to a first aspect of the present invention and a liquid ejection head production method according to a third aspect of the present invention will be described with reference to FIGS. 1 to 8C.

Figure 1:
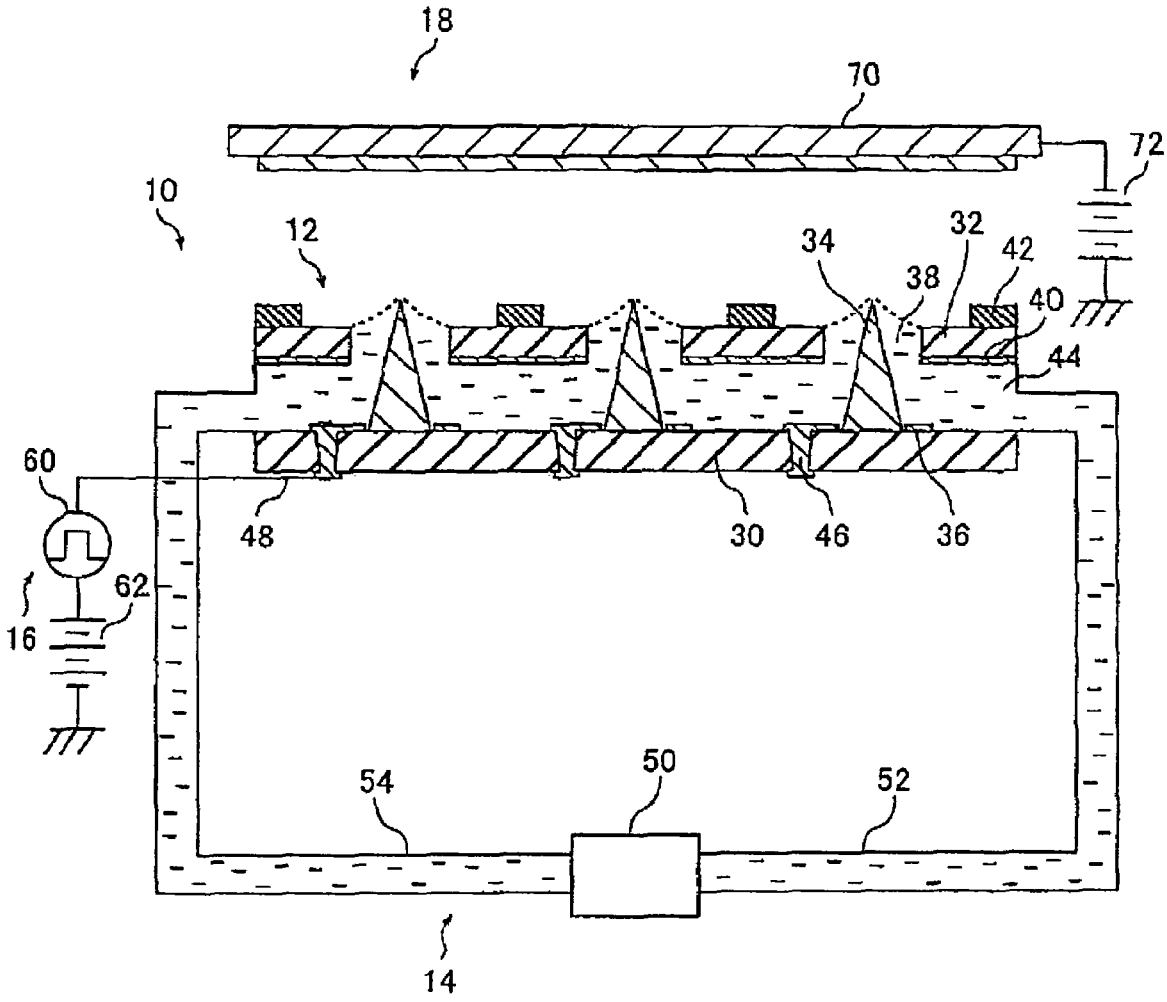
FIG. 1 is a schematic diagram showing an outline construction of an embodiment of the liquid ejection head according to the present invention.
Figure 2:
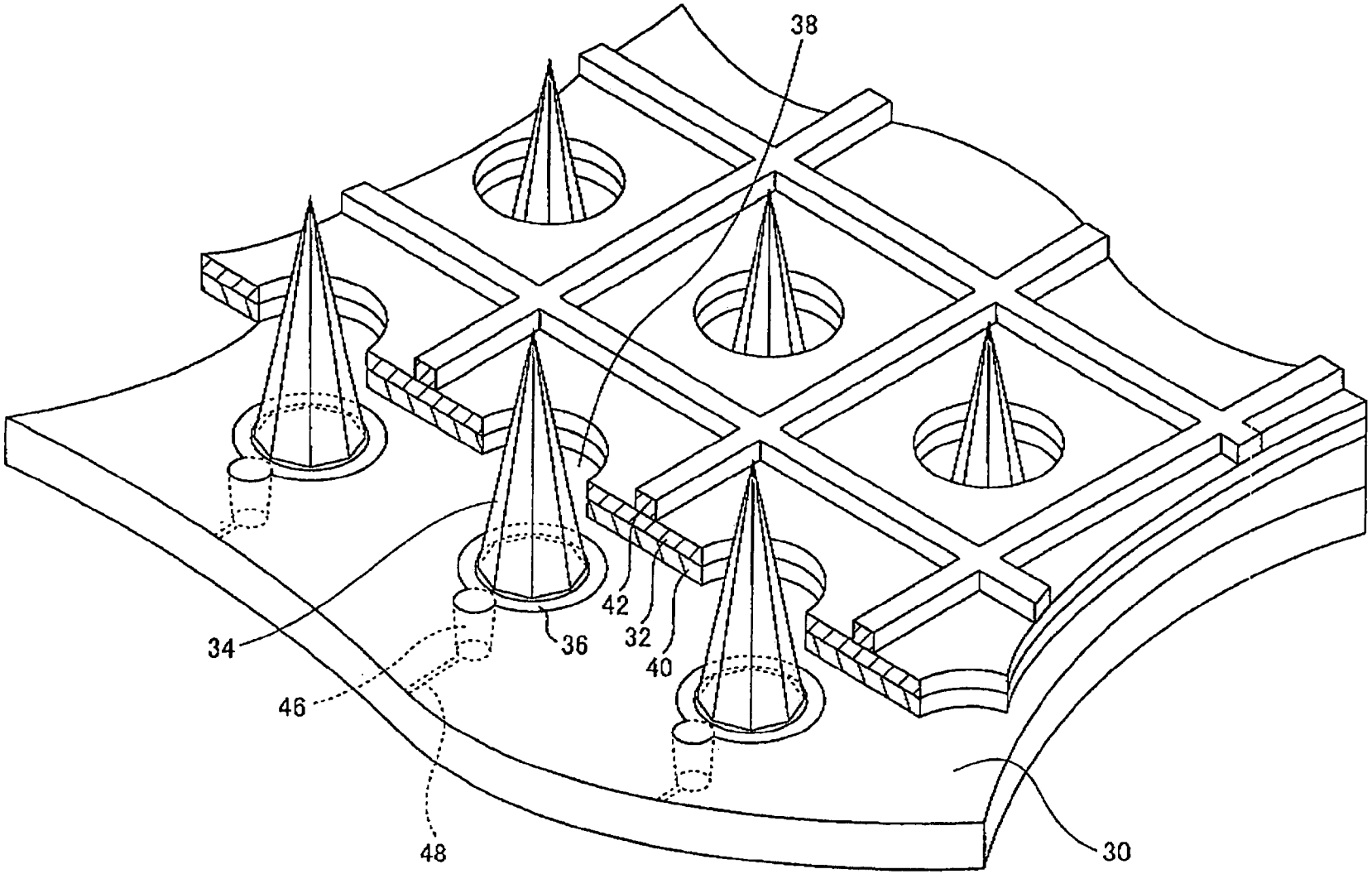
FIG. 2 is an outline perspective view of the liquid ejection head shown in FIG. 1.
Figure 3:
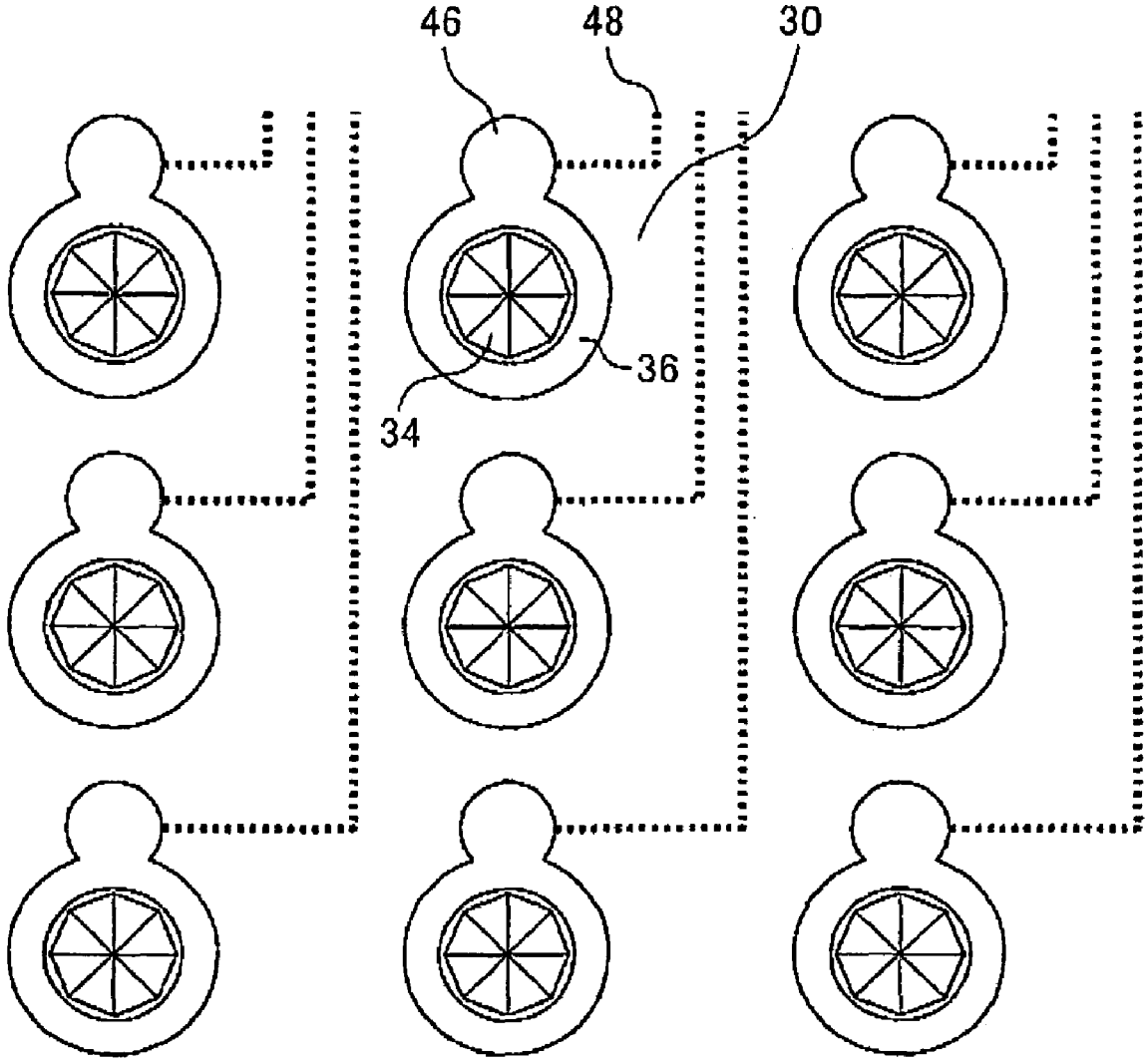
FIG. 3 is a schematic diagram showing an arrangement example of ejection electrodes of the liquid ejection head shown in FIG. 1.

FIG. 1 is a schematic diagram of an embodiment of an ink jet recording apparatus including an ink jet head according to an embodiment of the liquid ejection head according to the first aspect of the present invention. FIG. 2 is a perspective view of the ink jet head shown in FIG. 1. FIG. 3 is a schematic diagram showing an arrangement example of ejection electrodes shown in FIG. 1.

As shown in FIG. 1, an ink jet recording apparatus 10 includes an ink jet head 12, ink circulation means 14, voltage application means 16, and recording medium supporting means 18 arranged at a position opposing the ink jet head 12.

The ink jet head 12 includes a head substrate 30, a through-hole substrate 32, ink guides 34, ejection electrodes (control electrodes) 36, a shield electrode 40, and 3-D barriers 42.

The shield electrode 40 is arranged on a head substrate 30 side of the through-hole substrate 32, the 3-D barriers 42 are arranged on recording medium supporting means 18 side thereof, and through-holes 38 serving as ejection ports are formed or established in the through-hole substrate 32 and the shield electrode 40.

The head substrate 30 is arranged so as to be spaced apart from the through-hole substrate 32 by a predetermined distance and a gap therebetween serves as an ink flow path 44. Also, the ink guides 34, whose tip ends protrude toward the recording medium supporting means 18 side from the through-holes 38, are provided on a surface of the head substrate 30 on a through-hole substrate 32 side at positions corresponding to the through-holes 38.

The ejection electrodes 36 are provided around the base portions of the ink guides 34 on the head substrate 30 in a ring manner so as to surround the ink guides 34 with a predetermined distance therebetween. Also, the ejection electrodes 36 are connected to the voltage application means 16 through electrode drawing portions 46 and a wiring portion 48. Here, the electrode drawing portions 46 are provided so as to pass through the head substrate 30 and are connected to the ejection electrodes 36, and the wiring portion 48 is provided on a surface of the head substrate 30 on a side opposite to an ink flow path 44 side.

The ink circulation means 14 includes an ink reflux mechanism 50 for circulating ink to the ink jet head 12, an ink supply flow path 52, and an ink recovery flow path 54.

The ink reflux mechanism 50 is connected to the ink jet head 12 through the ink supply flow path 52 and the ink recovery flow path 54.

The voltage application means 16 includes a signal voltage supply 60 that applies a drive voltage (pulse voltage, for instance) at a predetermined potential corresponding to ejection data (ejection signal), such as image data or print data, to the ejection electrodes 36 to be described later and a bias voltage supply 62 that constantly applies a predetermined fixed voltage to the ejection electrodes 36.

A positive-side terminal of the signal voltage supply 60 is connected to the wiring portion 48, a negative-side terminal of the signal voltage supply 60 is connected to a positive-side terminal of the bias voltage supply 62, and a negative-side terminal of the bias voltage supply 62 is grounded.

At a position opposing the ink jet head 12, the recording medium holding means 18 for supporting a recording medium P is arranged. The recording medium holding means 18 includes a counter electrode 70 and a bias voltage supply 72 that applies a negative high voltage to the counter electrode 70.

The counter electrode 70 is arranged so as to face an ink droplet ejection surface of the ink jet head 12. Also, a negative-side terminal of the bias voltage supply 72 is connected to the counter electrode 70 and a positive-side terminal thereof is grounded. Further, the recording medium P is supported by a surface of the counter electrode 70 on ink droplet ejection surface side of the ink jet head 12.

Here, to perform image recording at a higher density, it is preferable that as shown in FIG. 3, the ink jet head 12 have a multi-channel structure where ejection portions composed of the ink guides 34, the ejection electrodes 36, and the through-holes 38 are disposed in a two-dimensional manner.

It should be noted here that in the ink jet head 12 according to the present invention, it is possible to freely select the number and physical arrangement and the like of the ejection electrodes 36. For instance, the present invention is not limited to the multi-channel structure in the illustrated example and may be a line head having one ejection portion row. Also, the present invention may be applied to a so-called full-line head having ejection portion rows corresponding to the entire region of the recording medium P or a so-called serial head (shuttle type) where scanning is performed in a direction approximately orthogonal to a nozzle row direction. Also, the ink jet head according to the present invention is capable of supporting both of monochrome recording and color recording.

Hereinafter, each portion of the ink jet head 10 will be described in detail.

As shown in FIG. 1, on a surface of the head substrate 30 on a through-hole substrate 32 side, one ink guide 34 and one ejection electrode 36 are provided for each ejection portion. The head substrate 30 is made of an electrical insulative material such as glass or $SiO_2$.

As described above, the head substrate 30 and the through-hole substrate 32 are arranged so as to be spaced apart from each other by a predetermined distance and a gap therebetween serves as the ink flow path 44. The ink flow path 44 is connected to the ink supply flow path 50 and the ink recovery flow path 52 and functions as an ink reservoir (ink chamber) for supplying the ink to each ejection portion. Also, at the time of image recording, the ink is circulated in the ink flow path 44 by the ink reflux mechanism 50 in a predetermined direction (in FIG. 1, from the right side to the left side in the drawing) at a predetermined speed (ink flow of 200 mm/s, for instance). Further, the ink used in this embodiment is a solution in which positively charged particles (ink particles) are dispersed together with a charge control agent, a binder, and the like in an electrical insulative solvent having resistivity of $10^8$ Ωcm or more.

The ink guides 34 provided on the head substrate 30 have a polygonal pyramidal shape whose tip end has a sharply pointed convex shape. In the illustrated example, the ink guides 34 have an octagonal pyramidal shape. Meniscuses of the ink are formed between the tip end portions of the ink guides 34 and the through-holes 38 and the ink concentrates at the tip end portions of the ink guides. When a predetermined voltage is applied to the ejection electrodes 36 under this state, ink droplets are ejected from the tip end portions of the ink guides 34.

In this embodiment, the shape of the ink guides 34 is an octagonal pyramid. The present invention is not limited to this and the shape of the ink guides 34 may be changed to a polygonal pyramid except the octagonal pyramid, a cone, or an elliptical cone. Also, even when the shape of the ink guides 34 is not a pyramid or cone in its entirety, there occurs no problem so long as at least the tip end portions of the ink guides 34 have a sharply pointed shape. For instance, a shape may be used in which a cone or a polygonal pyramid, whose tip end is sharply pointed, is placed on a cylindrical column or a polygonal column.

In the present invention, the tip end portions of the ink guides 34 are formed in a sharply pointed shape, and electric fields can concentrate at the tip end portions of the ink guides 34. As a result, it becomes possible to eject ink droplets with stability at a low voltage as compared with a conventional case. In addition, minute droplets can be ejected.

In this embodiment, it is preferable that the tip end angle of the tip end portions of the ink guides 34 be 60° or less and/or the radius of curvature of the tip end portions be 4 μm or less. In the present invention, it is not required to form the tip ends of the ink guides 34 at such a high sharply pointed degree when it is possible to eject droplets from the ink guide tip ends with stability at a desired ejection voltage, although in order to eject the ink with more stability at a lower ejection voltage, it is preferable that the tip end angle of the tip end portions of the ink guides be 60° or less and/or the radius of curvature of the tip end portions be 4 μm or less.

Also, the surface of a partial region of each ink guide 34 including the extreme tip end portion may be coated with a conductive film made of a metal or the like. When such a conductive film is formed for the extreme tip end portion, a dielectric constant of the tip end portion is substantially increased. It is therefore easy to generate a strong electric field and possible to improve an ink droplet ejection property.

The ejection electrodes 36 are arranged on the upper surface (surface on a side opposing the through-hole substrate 32) of the head substrate 30 as ring-shaped circular electrodes surrounding the peripheries of connection portions between the ink guides 34 and the head substrate 30. Also, the ejection electrodes 36, the ink guides 34, and the through-holes 38 are arranged so that they become substantially coaxial, that is, the centers thereof approximately coincide with each other. In this example, a construction has been described in which the ejection electrodes 36 are formed on the surface of the head substrate 30 so as to be exposed to the ink flow path. The present invention is not limited to this and the ejection electrodes 36 may be formed inside the head substrate 30 in a positional relation where the ejection electrodes 36 are substantially coaxial with the through-holes 38.

Figure 25:
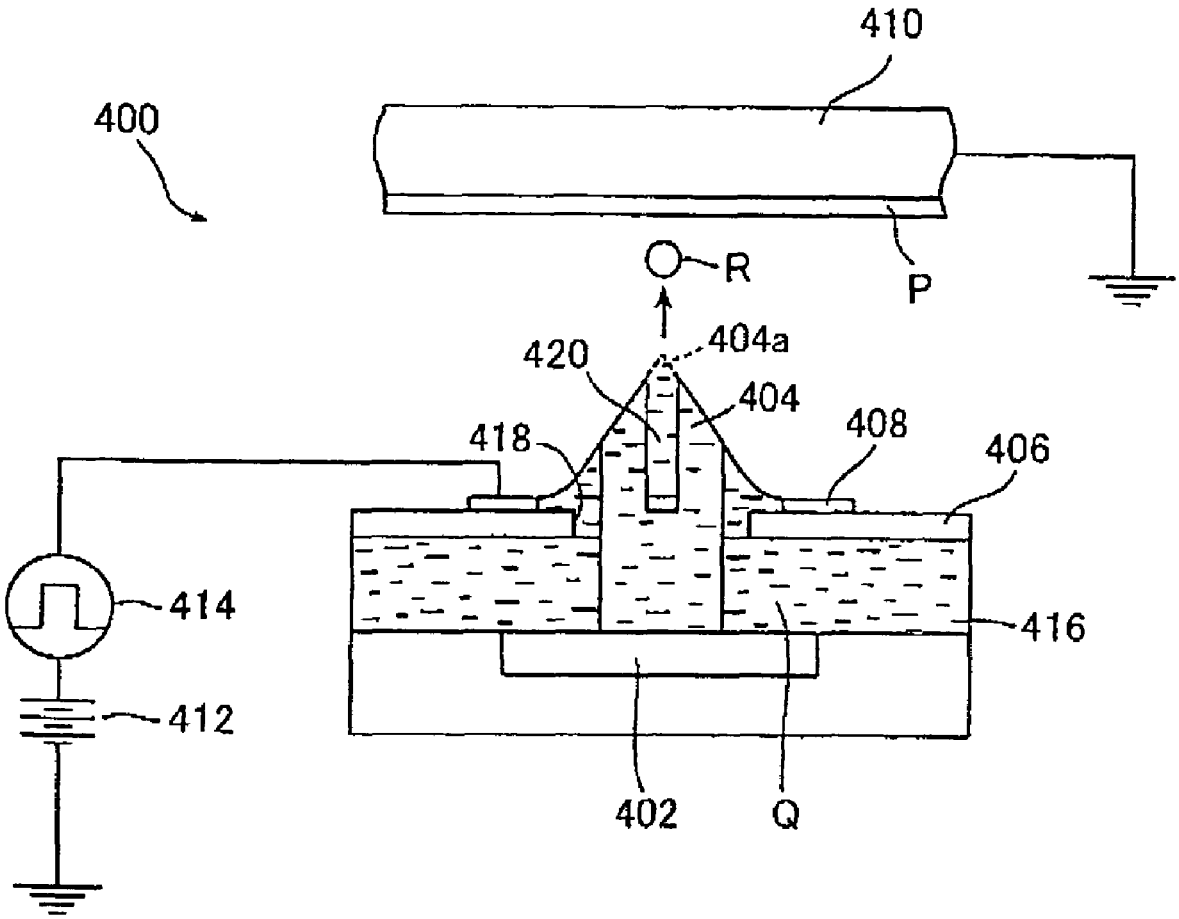
FIG. 25 PRIOR ART
FIG. 25 is a schematic diagram showing an example of a conventional liquid ejection head.

In the case of the conventional ink jet head shown in FIG. 25 where the ejection electrode is provided for the ejection opening substrate (through-hole substrate), when a drive voltage is applied to the ejection electrode, an electric field is generated not only from the upper surface of the ejection electrode but also from the lower surface of the ejection electrode. That is, an electric field directed from the through-hole to the head substrate acts on the ink circulating in the ink flow path. The electric field, generated from the lower surface of the ejection electrode in a direction orthogonal to the head substrate surface, acts so as to prevent the ink particles contained in the ink circulating in the ink flow path from moving toward the through-hole. Therefore, when the drive voltage is applied to the ejection electrode, concentration of the ink particles in the ejection opening (through-hole) is prohibited and a certain time is required before the ink particles are sufficiently concentrated in the through-hole.

Also, with the construction where the ejection electrode is provided for the through-hole substrate, warpage occurs to the through-hole substrate and a distance between the ink guide tip end portion and the ejection electrode changes. This distance change results in a situation where the distance between the ink guide tip end portion and the ejection electrode varies from ejection portion to ejection portion and ink droplets ejected from the ejection portions become nonuniform.

In contrast to this, in the ink jet head 12 according to the present invention, the ejection electrodes 36 are provided for the head substrate 30. Therefore, it is possible to cause only electric fields generated from the upper surfaces of the ejection electrodes 36 to act on the ink particles. That is, no electric field that prevents concentration of the ink particles exists at the through-holes 38, and the ink particles can concentrate in the through-holes 38 swiftly.

In addition, the multiple ink guides 34 and the multiple ejection electrodes 36 are formed integrally with the head substrate 30. Thus, distances between the ink guides 34 and the ejection electrodes 36 become constant, which prevents the situation described above where the distance between the ink guide 34 and the ejection electrode 36 varies from ejection portion to ejection portion. Therefore, a drive voltage necessary for ejection is fixed from ejection portion to ejection portion and it becomes possible to eject multiple ink droplets at a high frequency with stability using a low drive voltage generally.

Figure 4:
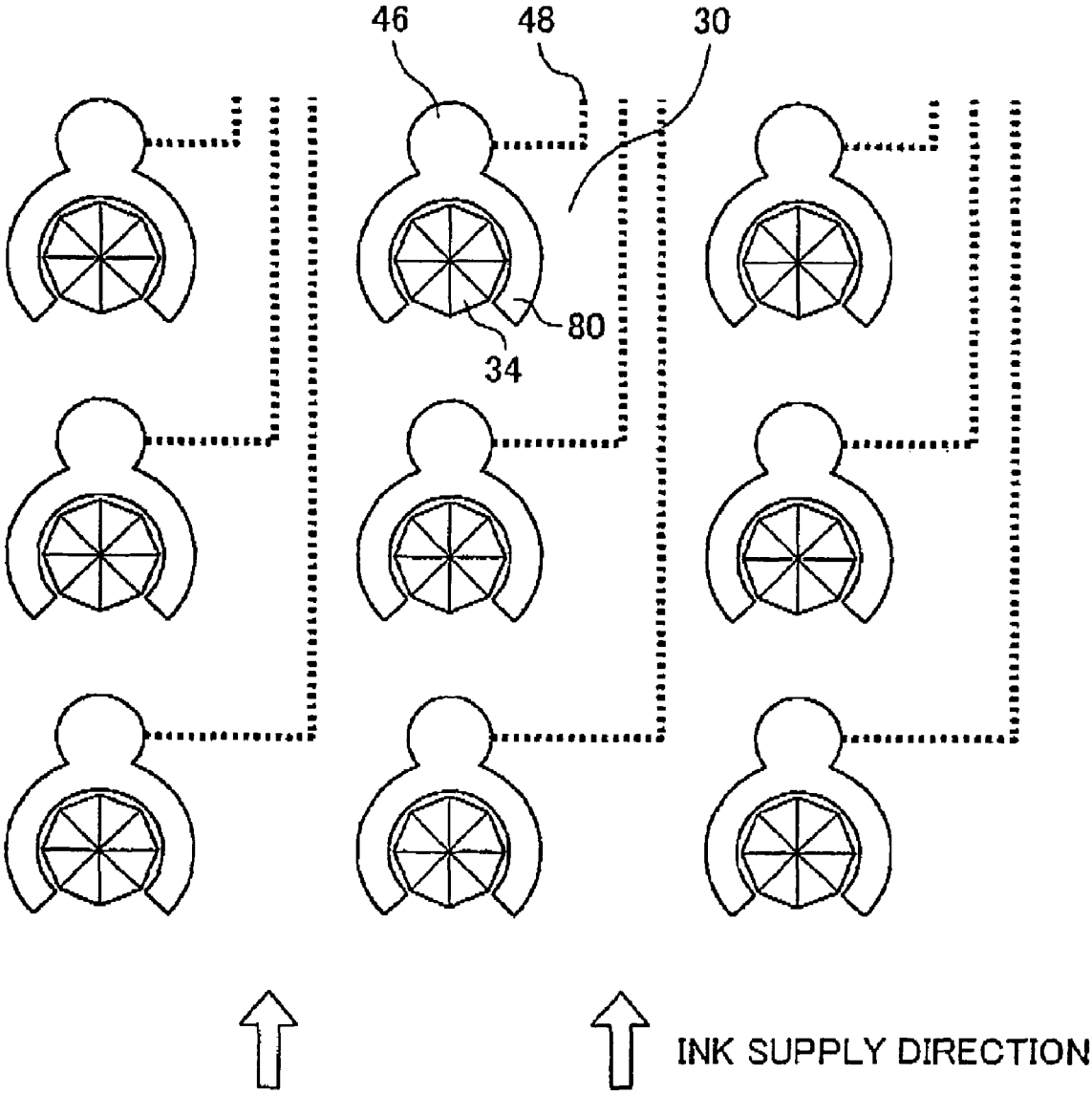
FIG. 4 is a schematic diagram showing another example of the arrangement of the ejection electrodes of the liquid ejection head shown in FIG. 1.

Here, the ejection electrodes 36 are preferably formed in, for instance, shapes shown in FIG. 4 where the circular electrodes are partially removed on an ink supply side (ink flow path upstream side). By thus partially removing the ejection electrodes 80 on the ink flow path upstream side or the ink supply side, a repulsive force exerted on the ink particles as a result of application of the drive voltage to the ejection electrodes 80 at the time of recording is reduced on the ink supply side. As a result, even at the time of recording, it becomes possible to supply the ink particles to the ink guide 34 with efficiency.

It should be noted here that the ejection electrodes are not limited to the ring-shaped circular electrodes and it is possible to use various electrodes in other shapes such as polygonal electrodes.

Also, it is preferable that a ratio between an inside diameter of the ejection electrodes 36 and a distance from surfaces of the ejection electrodes 36 to the tip ends of the ink guides 34 is in a range of 1:0.5 to 1:2, more preferably in a range of 1:0.7 to 1:1.7. That is, when the inside diameter of the ejection electrodes 36 is referred to as "r" and the distance from the surfaces of the ejection electrodes 36 to the tip ends of the ink guides 34 is referred to as "h", it is preferable that at least one of the inside diameter of the ejection electrodes 36 and the distance from the surfaces of the ejection electrodes 36 to the tip ends of the ink guides 34 be adjusted so that "h/r" falls in a range of 0.5 to 2, more preferably in a range of 0.7 to 1.7. This is because when the ratio "h/r" exists in the range described above, the electric fields formed by the ejection electrodes 36 are converged and the strongest electric fields are formed. Therefore, by arranging the tip end portions of the ink guides 34 that are ejection points at positions satisfying the range described above, even when the application voltage to the ejection electrodes 36 is lowered as compared with the conventional case, it becomes possible to eject droplets from the tip end portions of the ink guides 34 with reliability. That is, it becomes possible to realize lowering of the application voltage to the ejection electrodes 36.

The electrode drawing portions 46 are made of a conductive material, such as a metal, and are provided so as to pass through the head substrate 30 at positions where the surface of the head substrate 30 on the ink flow path 44 side overlaps the ejection electrodes 36. The back surfaces (surfaces on a side opposite to the ink flow path 44 side) of the electrode drawing portions 46 contact the wiring portion 48 and the electrode drawing portions 46 electrically connect the ejection electrodes 36 and the wiring portion 48 to each other.

The shape and arrangement position of the electrode drawing portions 46 are not limited so long as the electrode drawing portions 46 electrically connect the ejection electrodes 36 and the wiring portion 48 to each other. For instance, the whole of the surfaces of the electrode drawing portions 46 on the ink flow path 44 side may be contained in a part of the ejection electrodes 36.

Also, the electrode drawing portions 46 are preferably provided so as to overlap a part of the ejection electrodes 36 on the downstream side of the flow path in which the ink flows.

With this construction where the electrode drawing portions 46 are formed on the downstream side of the ejection electrodes 36, no electric field is generated in a direction in which concentration of the ink to the ink guides 34 is prohibited, so the ink concentrates at the ink guides 34 with efficiency.

The wiring portion 48 is provided on the back surface of the head substrate 30 (surface opposite to the surface of the head substrate 30 on which the ejection electrodes 36 are arranged) and connects the voltage application means 16 and the electrode drawing portions 46 to each other.

By thus providing the wiring portion 48 for applying the voltage from the bias voltage supply 60 to the ejection electrodes 36 on the back surface of the head substrate 30, it becomes possible to uniformize the concentration of the ink in each ejection portion without exerting any influences on the ink in the ink flow path 44 and also uniformly form an electric field in each ejection portion. Therefore, ejection of ink droplets in each ejection portion can be performed with stability.

The through-hole substrate 32 is made of an electrical insulative material such as ceramics like $Al_2O_3$ or $ZrO_2$ or a resin like polyimide. Also, as described above, in the through-hole substrate 32, the through-holes 38 are formed which supply the ink to the tip end portions of the ink guides 34, with meniscuses being formed between the through-holes 38 and the ink guides 34.

In the present invention, the ejection electrodes 36 are provided not for the through-hole substrate 32 but for the head substrate 30, and the thickness of the through-hole substrate 32 can be reduced as compared with the conventional case. Therefore, it becomes possible to reduce the length of the through-holes 38 as compared with the conventional case, which reduces the resistances between the ink and the inner walls of the through-holes 38 and makes it possible to eject the ink from the through-holes 38 swiftly. In addition, the ink is prevented to stay in the through-holes 38 depending on the speed of the ink flow.

Also, the shape of the through-holes 38 is independent of the shape of the ejection electrodes 36, so it is possible to form the through-holes 38 in various shapes, such as a circular shape, an elliptical shape, and a quadrilateral shape, in accordance with purposes such as an improvement in supply efficiency of the ink to the tip end portions of the ink guides 34 and stabilization of the meniscuses.

Further, ink repellency giving processing is preferably performed on a surface of the through-hole substrate 32 on a recording medium P side. Performing the ink repellency giving processing on the surface of the through-hole substrate 32 makes it possible to form the meniscuses with stability and stabilize ejection of ink droplets. Here, the ink repellency means water repellency when the ink is water-based ink and means oil repellency when the ink is oil-based ink.

Also, it is sufficient that the surface of the through-hole substrate 32 has the ink repellency, and the present invention is not limited to the ink repellency giving processing. For instance, the through-hole substrate 32 may be made of an ink repellent material, or an ink repellent material may be applied to the surface of the through-hole substrate 32 on the recording medium P side. Even with one of such constructions, the meniscuses are formed with stability and ejection of ink droplets is stabilized like in the case of the construction described above.

The shield electrode 40 arranged on a surface of the through-hole substrate 32 on a head substrate 30 side is provided at a position that is closer to the recording medium P than the ejection electrodes 36. The shield electrode 40 is arranged so as not to shield from electric lines of force generated from each ejection electrode 36 toward the tip end portion of the ink guide 34 corresponding to the ejection electrode 36 and to shield from electric lines of force generated from each ejection electrode 36 toward the tip end portions of the ink guides 34 noncorresponding to the ejection electrode 36.

In this embodiment, the shield electrode 40 is a sheet-shaped electrode, such as a metallic plate, which is common to the respective ejection portions and includes opening portions bored so as to respectively oppose the through-holes 38 established in a two-dimensional manner. The shield electrode 40 is held at a predetermined potential (including 0 V through grounding). In this embodiment, the shield electrode 40 is grounded and is set at 0 V.

Here, it is not necessarily required to provide the shield electrode 40. However, the shield electrode 40 is preferably provided because it is possible to shield each ejection portion from the electric lines of force generated from noncorresponding ejection electrodes 36 and form a stabilized electric field at the ejection portion with this construction.

It is sufficient that the shield electrode 40 is arranged between the ejection electrodes 36 and the tip end portions of the ink guides 34, and the arrangement position of the shield electrode 40 is not limited to the head substrate 30 side of the through-hole substrate 32 and may be changed to the recording medium P side of the through-hole substrate 32 or the inside of the through-hole substrate 32.

Also, in this embodiment, the shield electrode 40 serves as a sheet-shaped electrode. The present invention is not limited to this and any other electrode may be used so long as it is possible to shield the ejection portion from the electric lines of force from the noncorresponding ejection electrodes 36.

Also, in this embodiment, the shield electrode 40 is provided on the ink flow path 44 side of the through-hole substrate 32, although it is possible to achieve the functions of both the shield electrode and the ink repellency giving processing by performing eutectoid-plating of a fluoride polymer and a metal on the surface of the through-hole substrate on the counter electrode side.

The 3-D barriers 42 are provided on the surface of the through-hole substrate 32 on the recording medium P side so as to surround the through-holes 38. The 3-D barriers 42 are thus arranged, so the meniscuses formed at the adjacent ink guides 34 are prevented from being connected with each other and are separated from each other.

Here, in the present invention, it is not necessarily required to provide the 3-D barriers 42. However, the 3-D barriers 42 are preferably provided because it becomes possible to separate meniscuses formed at the adjacent ink guides 34 from each other and maintain the respective meniscuses formed at the respective ink guides 34 with stability without being influenced by fluctuations of the meniscuses at the time of ejection of ink droplets from the adjacent ink guides 34.

In this embodiment, the 3-D barriers 42 are arranged in a lattice manner but the present invention is not limited to this. It is sufficient that the 3-D barriers 42 have a shape where the meniscuses formed at the respective ink guides 34 are prevented from being connected with each other and are separated from each other. For instance, 3-D barriers that respectively surround the through-holes may be provided separately from each other.

Also, in order to separate the meniscuses formed at the adjacent ink guides 34 from each other with more reliability by preventing the ink from climbing the wall surfaces of the 3-D barriers 42, at least the surfaces of the 3-D barriers 42 preferably have ink repellency.

The ink reflux mechanism 50 includes an ink tank and an ink pump (not shown), with a predetermined amount of ink being contained in the ink tank. In the ink tank, the concentrations of the charged particles, the charge control agent, the binder, and the like in the insulative solvent of the ink are constantly adjusted by a concentration adjustment mechanism (not shown) so as to fall within predetermined concentration ranges. The ink adjusted in concentrations by the concentration adjustment mechanism (not shown) in the ink tank is supplied from the ink pump of the ink reflux mechanism 50 to the ink flow path 44 of the ink jet head 12 through the ink supply flow path 52 at a predetermined pressure. The ink flow path 44 is filled With the ink and the ink is supplied to the ink guides 34 through the respective through-holes 38. Also, the ink used in the ink jet head 12 is recovered by the ink reflux mechanism 50 through the ink recovery flow path 54.

The ejection electrodes 36 are connected to the signal voltage supply 60 and the bias voltage supply 62 of the voltage application means 16 through the electrode drawing portions 46 and the wiring portion 48. The signal voltage supply 60 applies a drive voltage (pulse voltage, for instance) at a predetermined potential corresponding to ejection data (ejection signal), such as image data or print data, to the ejection electrodes 36 and the bias voltage supply 62 constantly applies a fixed voltage to the ejection electrodes 36 at the time of recording.

As described above, the bias voltage supply 62 applies the fixed voltage to the ejection electrodes 36, and it becomes possible to set the drive voltage that the signal voltage supply 60 applies to the ejection electrodes 36 as a low voltage, thereby reducing power consumption.

The counter electrode 70 is arranged so as to face the ink droplet ejection surface of the ink jet head 12. Also, a negative-side terminal of the bias voltage supply 72 is connected to the counter electrode 70 and a positive-side terminal thereof is grounded.

At the time of recording, the recording medium P is supported by a surface of the counter electrode 70 on the lower side in FIG. 1 through, for instance, electrostatic attraction and the counter electrode 70 functions as a platen of the recording medium P. In addition, to the counter electrode 70, a predetermined voltage is applied from the bias voltage supply 72.

Next, an ink droplet ejection operation of the ink jet recording apparatus 10 will be described.

As described above, in the ink jet head 12, the ink containing charged particles which have a fixed concentration is circulated and meniscuses covering at least the tip end portions are formed on the surfaces of the ink guides 34. Under this state, a voltage of 100 V is applied from the bias voltage supply 62 of the voltage application means 16 to the ejection electrodes 36, and a voltage of −1 kV is constantly applied from the bias voltage supply 72 to the counter electrode 70. Electric fields corresponding to a potential difference of 1.1 kV generate between the ejection electrodes 36 and the counter electrode 70.

Here, when a drive voltage of 200 V is applied to the ejection electrodes 36 from the signal voltage supply 60 in addition to the voltage of 100 V applied from the bias voltage supply 62, a voltage of 300 V in total is applied. The voltage of 300 V is applied to the ejection electrodes 36 and the voltage of −1 kV is applied to the counter electrode 70. The electric fields generated between the ejection electrodes 36 and the counter electrode 70 are strengthened to electric fields corresponding to a potential difference of 1.3 kV. As a result of the strengthened electric fields, ink droplets are ejected from the meniscuses toward the counter electrode 70 by means of an electrostatic force and adhere onto the recording medium P.

The ink guides whose tip ends are sharply pointed, and the ejection electrodes are provided on the head substrate in the manner described above. Ink droplets can be ejected with stability at high speed through low-voltage driving and a high-quality image can be formed at a low cost.

Also, the flying positions of ink droplets are determined at the centers of the tip end portions of the ink guides 36 and ink droplets will not be displaced in a main scanning direction at the time of flying.

Figure 5:
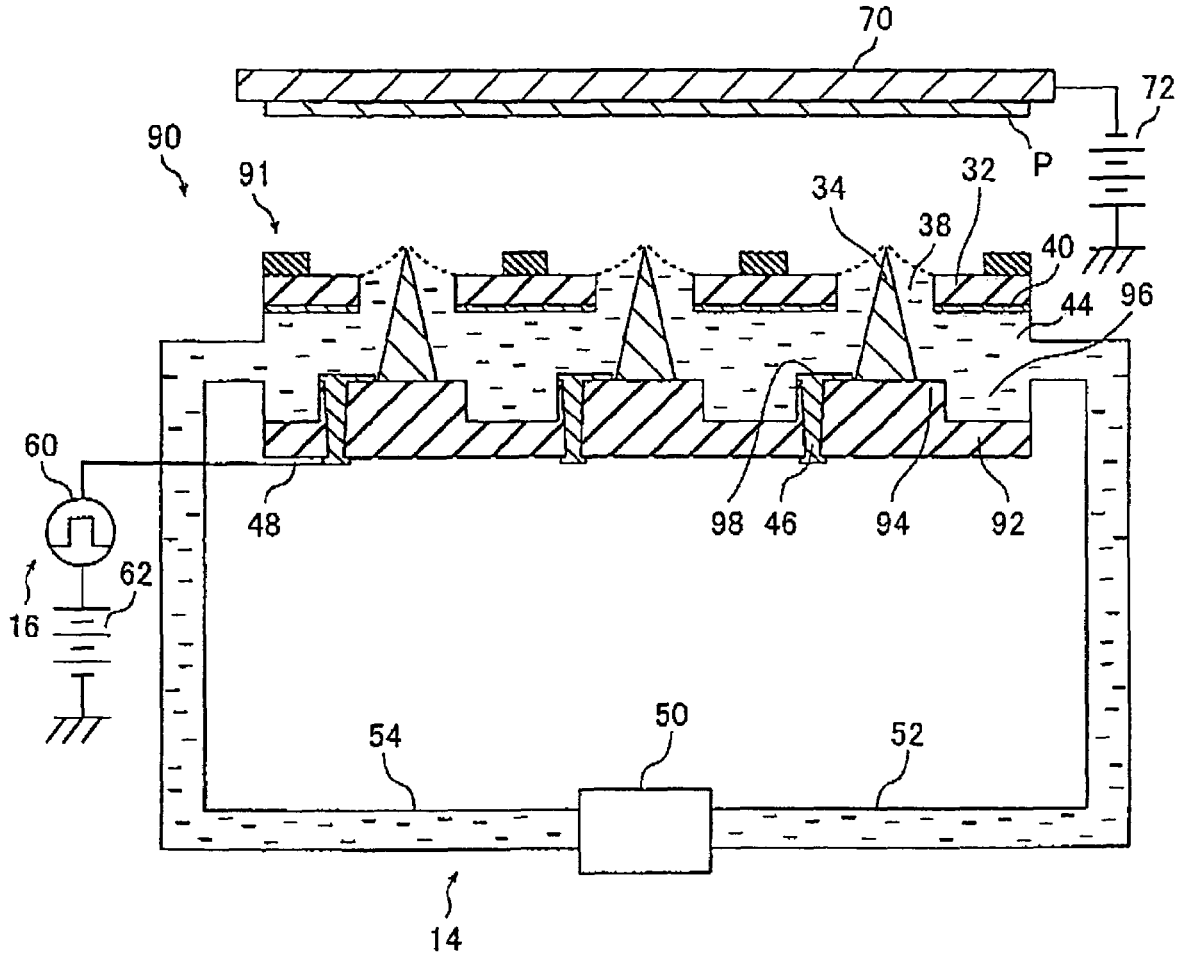
FIG. 5 is a schematic diagram showing an outline construction of another embodiment of the liquid ejection head according to the present invention.
Figure 6:
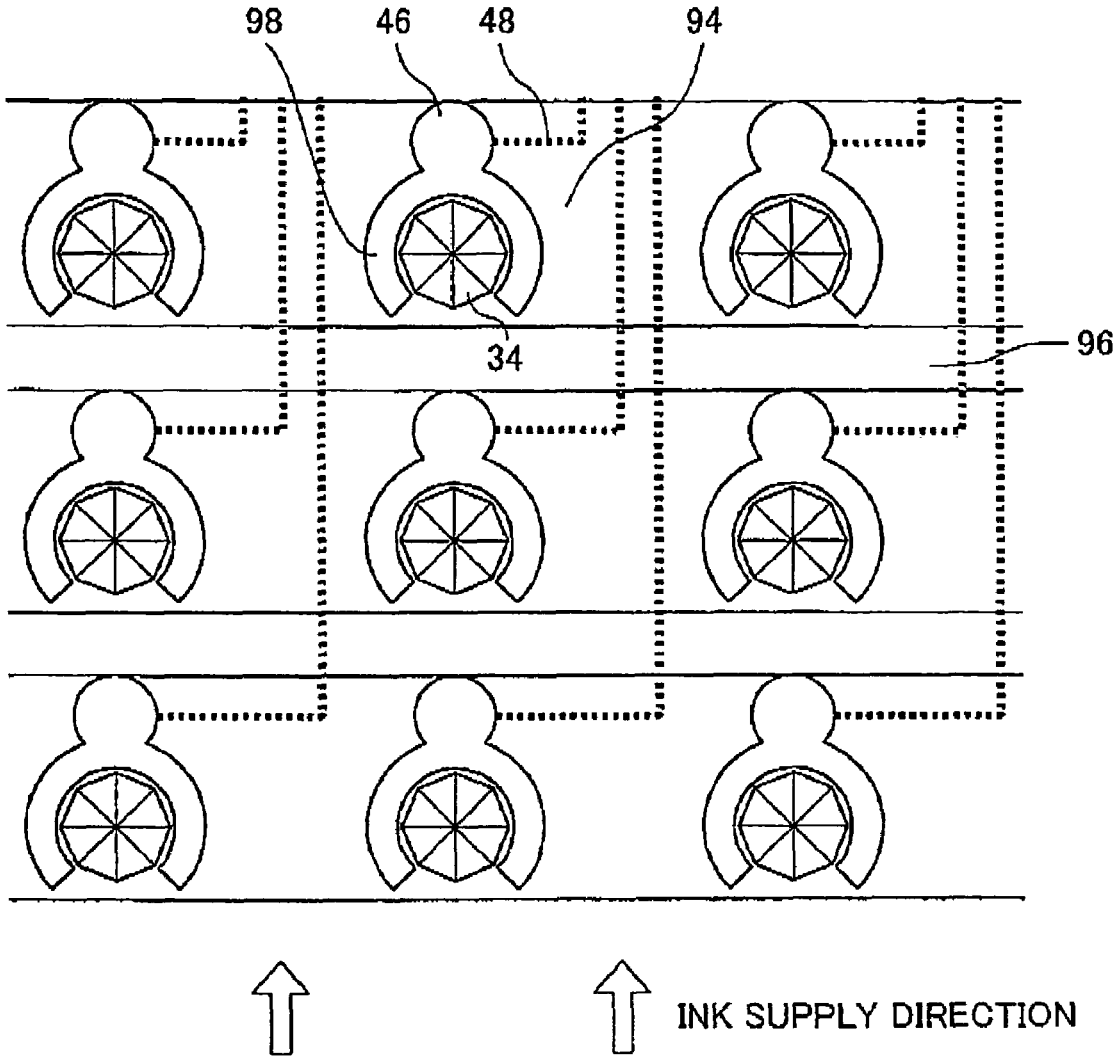
FIG. 6 is a schematic diagram showing an arrangement example of ejection electrodes of the liquid ejection head shown in FIG. 5.

FIG. 5 is a schematic diagram showing an outline construction of another embodiment of an ink jet recording apparatus including an ink jet head according to another embodiment of the liquid ejection head according to the first aspect of the present invention. FIG. 6 is a schematic diagram showing an arrangement example of ejection electrodes of the ink jet recording apparatus shown in FIG. 5. An ink jet recording apparatus 90 shown in FIGS. 5 and 6 has the same construction as the electrostatic ink jet recording apparatus 10 shown in FIGS. 1, 2, and 3 except some portions. Accordingly, in this embodiment, the same construction element as in the above embodiment is given the same reference numeral and the description thereof will be omitted. Therefore, in the following description, points unique to the ink jet recording apparatus 90 will be mainly explained.

A head substrate 92 of an ink jet head 91 according to this embodiment is provided with convex portions 94 common to ejection portions adjacent to each other in a direction orthogonal to a flow path in which ink flows (from the right side to the left side in FIG. 5, from the lower side to the upper side in FIG. 6). Therefore, ink guides 34 and ejection electrodes 98 are provided on the convex portions 94. Also, concave portions 96 having a predetermined depth are formed outside the ejection electrodes 98 in the direction orthogonal to the ink flow path. That is, ejection portions adjacent to each other in the direction orthogonal to the ink flow path are formed on the same convex portion 94 and the concave portions 96 are formed between the ejection portions adjacent to each other in the direction in which the ink flows.

Also, in this embodiment, the ejection electrodes 98 each have a shape where a part thereof on an ink supply side is removed like in the case of the ejection electrodes 80 shown in FIG. 4.

With this construction, the convex portions 94 function as leading weirs, so it becomes possible to lead the ink in an ink guide 34 tip end direction and supply the ink to the tip end portions of the ink guides 34 with efficiency.

Also, the concave portions 96 are provided, so it becomes possible to increase the area of the ink flow path 44. As a result, the amount of the ink flowing in the ink flow path 44 increases and the ink can be supplied to the tip end portions of the ink guides 34 with efficiency.

In this embodiment, the concave portions are formed in the direction orthogonal to the ink flow path. The present invention is not limited to this and another shape in which the concave portions are formed parallel to the ink flow path, that is, the respective ejection portions are arranged on the respective convex portions, may be used. When the concave portions are provided parallel to the ink flow path in this manner, the area of the ink flow path is further increased and it becomes possible to supply a larger amount of ink into the ink flow path.

Also, the shape of the convex portions is not specifically limited and various shapes are usable, such as a shape that traces the outside shape of the ejection electrodes and a shape where the side surfaces of the convex portions are inclined.

Further, in this embodiment, the ejection portions are arranged in a lattice manner and the convex portions are formed in a straight line manner in the direction orthogonal to the ink flow path. However, the ejection portions may be arranged in a staggered lattice manner and the convex portions may be provided in a staggered manner so as to correspond to the respective ejection portions. In this case, it becomes possible to supply the ink to the ejection portions with more efficiency.

Here, in the embodiment described above, explanation has been made using ink in which charged particles in a solution are positively charged, although ink in which charged particles are negatively charged may be used instead. In this case, it is sufficient that the polarities of the application voltages applied to the counter electrode and the ejection electrodes are reversed from those in the example described above.

The liquid ejection head according to the present invention is not limited to the head that ejects ink containing charged particles and any head that ejects a solution containing charged particles dispersed in a solvent can be used. There is no limitation on the type of the solution used.

Next, an ink jet head production method according to an embodiment (first embodiment) of the liquid ejection head production method according to a fourth aspect of the present invention will be described with reference to FIGS. 7A to 7K.

Here, only one ejection portion is illustrated in FIGS. 7A to 7K, although it is certainly possible to produce two-dimensionally disposed ejection portions at the same time using the production method in this embodiment.

In this embodiment, a glass substrate 100 is used as an example of a substrate that has an electrical insulation property and serves as a head substrate.

Figure 7A:
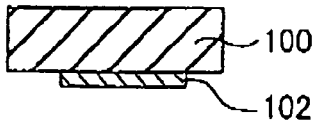
FIGS. 7A to 7K are each an outline diagram illustrating an embodiment of the liquid ejection head production method according to the present invention.

First, as shown in FIG. 7A, an electrode 102 serving as a wiring portion is formed on the glass substrate 100 by evaporating a metallic film onto the glass substrate 100, producing a mask corresponding to an electrode pattern of the wiring portion on the metallic film using a lithography method for instance, and etching the metallic film using the mask. Here, a method for evaporating the metallic film is not specifically limited and it is sufficient that the metallic film is evaporated using a conventionally known technique such as sputtering or CVD.

Figure 7B:
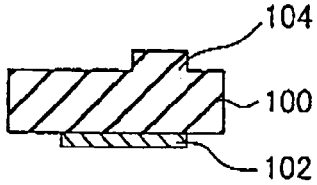

Next, as shown in FIG. 7B, a cylindrical column 104 serving as a convex portion, which is, for instance, around 5 μm in height and 200 μm in diameter, is formed by forming a circular mask having a diameter of around 200 μm for example at a position corresponding to a position, at which an ink guide is to be arranged, of a surface of the glass substrate 100 on a side opposite to the surface on which the electrode 102 has been formed, using the lithography method or the like, and etching the glass substrate 100 by a predetermined amount using the mask.

Figure 7C:
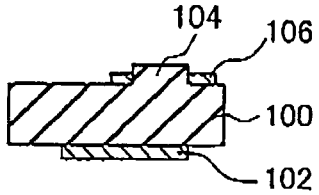

Then, as shown in FIG. 7C, a ring-shaped electrode 106 serving as an ejection electrode is formed around the cylindrical column 104 by evaporating a metallic film on the surface of the glass substrate 100 on which the cylindrical column 104 has been formed, producing a mask corresponding to the electrode pattern of the ejection electrode with a lithography method or the like so that only a ring-shaped portion of the metallic film surrounding the cylindrical column 104 is to be left, and etching the metallic film using the mask thus produced as an etching mask.

Here, by forming the mask in a shape where a part of a ring shape is removed and etching the metallic film using the mask as the etching mask, it is also possible to form the electrode whose part is removed as shown in FIG. 4.

Figure 7D:
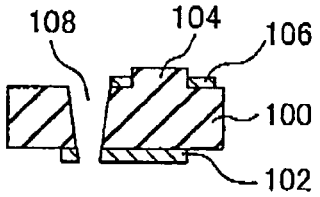

Next, as shown in FIG. 7D, a through-hole 108 is formed in the glass substrate 100 so that the electrode 102 and the ring-shaped electrode 106 form some portions of the inner wall surface of the through-hole 108. By thus forming the through-hole 108, the electrode 102 and the electrode 106 are partially exposed to the side surface of the through-hole 108.

It is sufficient that the through-hole 108 is formed using a conventionally known technique such as sand blasting or laser beam machining.

Figure 7E:
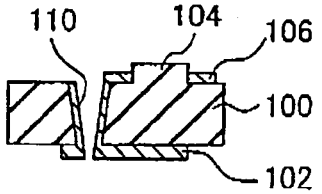

Next, as shown in FIG. 7E, for continuity between the electrode 102 and the electrode 106 on both surfaces of the glass substrate 100, a metallic film is evaporated onto the side surface of the through-hole 108, thereby forming an electrode 110 on the side surface of the through-hole 108. At this time, in order to prevent the metallic film from being evaporated on portions other than the side surface of the through-hole 108, a resist layer serving as a mask may be formed on portions where the metallic film is not to be evaporated.

Figure 7F:
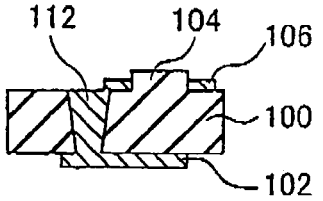

In addition, a metal is filled into the through-hole 108 by performing plating such as electroplating. As a result, as shown in FIG. 7F, a plated portion 112 serving as an electrode drawing portion is embedded in the through-hole 108. Here, the metal used to perform the plating is not specifically limited and various metals are usable so long as they are metals that will never be corroded even through contact with the ink. For instance, it is preferable to use copper, nickel, or the like.

Figure 7G:
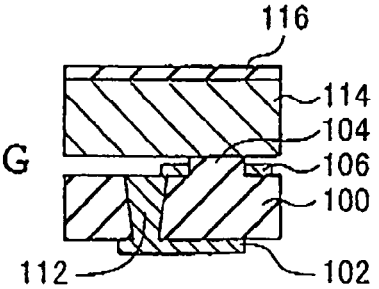

Next, in this embodiment, as shown in FIG. 7G, an Si substrate 114 is joined to a surface of the glass substrate 100 on which the cylindrical column 104 has been formed. As a joining method, various methods are usable, such as anode joining and a method based on an adhesive. Here, as the anode joining, it is possible to use a method with which after the Si substrate 114 is placed on the glass substrate 100, a voltage of several hundred V is applied while performing heating, thereby generating an electrostatic attractive force between the glass substrate 100 and the Si substrate 114 and achieving the joining through covalent bonding. Also, as to the joining between the glass substrate 100 and the Si substrate 114, it is sufficient that at least the cylindrical column 104 of the glass substrate 100 is joined with the Si substrate 114.

Here, as shown in FIG. 7G, an oxide film 116 is formed on a surface of the Si substrate 114 that is not joined with the glass substrate 100. The oxide film 116 is generally formed through film formation using $SiO_2$ based on sputtering, CVD (chemical vapor deposition), or thermal oxidation or through oxidation before the joining with the cylindrical column 104 of the glass substrate 100. Also, the surface of the Si substrate 114 on which the oxide film 116 has been formed is a <100> crystalline plane.

Figure 7H:
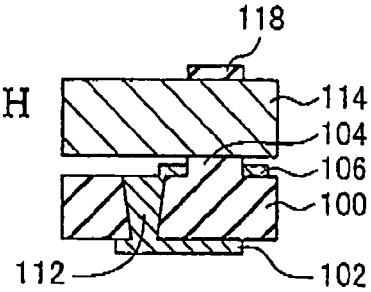

Next, a square resist pattern whose sides coincide with the <110> and <1-10> crystal orientations of the Si substrate 114, is formed on the oxide film 116 using a lithography method or the like at a position corresponding to arrangement of the ink guide. Following this, the oxide film 116 is etched using the resist pattern as an etching mask. As a result, as shown in FIG. 7H, the oxide film 116 becomes a mask 118 having a shape corresponding to the shape of the square resist pattern, that is, a square shape whose sides coincide with the <110> and <1-10> crystal orientations of the Si substrate 114.

Figure 7I:
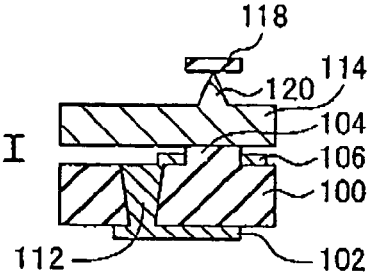

Next, the Si substrate 114 is immersed in, for instance, a 34 wt % aqueous solution of KOH heated to 70° C. and anisotropic etching of the Si substrate is performed. In this etching step, the Si substrate 114 is anisotropically etched using the square mask 118 as an etching mask. During this etching, undercut progresses from the square portion of the mask 118 and the etching is continued until the mask 118 is separated from the surface of the Si substrate 114. In this manner, as shown in FIG. 7I, a pyramidal structural member 120 that is formed by inclined surfaces of a high-order polyhedron and serves as the tip end portion of the ink guide having a sharpened tip end whose tip end angle is 60° or less and/or whose radius of curvature is 4 μm or less, is formed in a part of the Si substrate 114. Here, even after the anisotropic etching of the Si substrate 114 is performed, the Si substrate 114 is left by a predetermined thickness. The pyramidal structural member 120 is formed on the Si substrate 114 having the predetermined thickness.

Figure 7J:
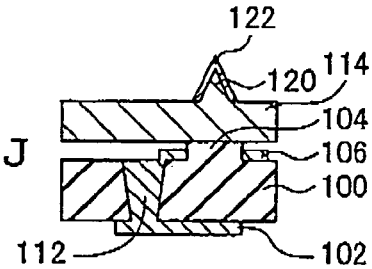

Next, as shown in FIG. 7J, a mask 122 resistant to Si etching is formed using $SiO_2$, a metal, or the like for the pyramidal structural member 120.

Figure 7K:
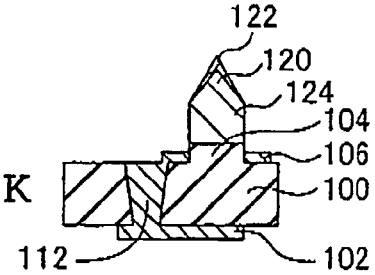

Next, the Si substrate 114 is etched through Deep-RIE using the mask 122 as an etching mask, thereby forming a columnar structural member 124, which has the pyramidal structural member 120 in its tip end portion and serves as a base portion of the ink guide, on a surface of the cylindrical column 104 as shown in FIG. 7K.

With the method described above, it is possible to produce a head-substrate-side structural body including the ink guide whose tip end is sharply pointed, the ejection electrode provided on the head substrate so as to surround the ink guide, the electrode drawing portion for establishing connection with voltage application means for applying a voltage to the ejection electrode, and the wiring portion provided on a surface opposite to the surface on which the ejection electrode of the head substrate has been arranged.

In addition, it is possible to produce an ink jet head through assembling where a through-hole substrate including through-holes at positions corresponding to ejection portions is placed at a position spaced apart from the head substrate of the head-substrate-side structural body produced in the manner described above by a predetermined distance.

Here, in this embodiment, the pyramidal structural member serving as an ink guide is produced using an Si substrate. The present invention is not limited to this and it is sufficient that a single crystal substrate made of InP, GaAs, or the like on which anisotropic etching can be performed is used.

By thus manufacturing the liquid ejection head using, for instance, lithography and dry etching of a semiconductor manufacturing method, an ink guide can be produced and an ejection electrode having high reliability and high accuracy. As a result, it becomes possible to produce an ink jet head at a low cost.

Also, by producing the ink guide in the manner described above, an ink guide having a sharply pointed tip end can be produced with high accuracy.

Next, another embodiment (second embodiment) of the liquid ejection head production method according to the second aspect of the present invention will be described with reference to FIGS. 8A to 8C.

It should be noted here that the production method in this embodiment is the same as that in the embodiment described above based on FIGS. 7A to 7K except for the ink guide production method. Different points will be mainly described in the following explanation.

First, like the production method described based on FIGS. 7A to 7K, an electrode 102 serving as a wiring portion is formed for a glass substrate 100, a cylindrical column 104 serving as a convex portion is formed on a surface opposite to the surface on which the electrode 102 has been formed, at a position corresponding to arrangement of an ink guide, an electrode 106 serving as an ejection electrode is formed so as to surround the cylindrical column 104, a through-hole is formed so that the electrode 102 and the electrode 106 constitute some portions of the inner wall of the through-hole, a metallic film is evaporated onto the side surface of the through-hole, and a plated portion 112 serving as an electrode drawing portion is produced by performing plating so as to fill the through-hole.

Figure 8A:
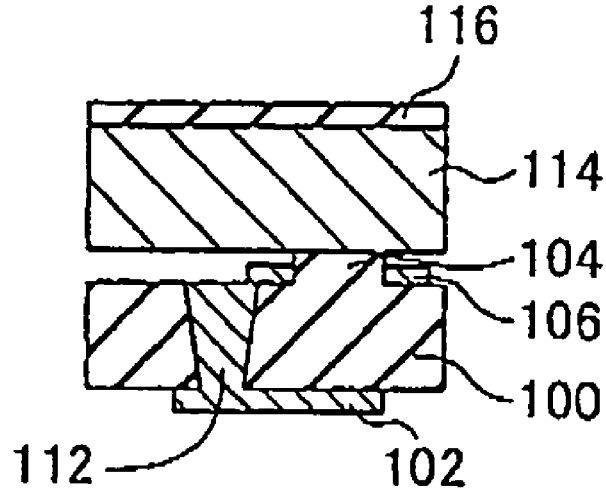
FIGS. 8A to 8C are each an outline diagram illustrating another embodiment of the liquid ejection head production method according to the present invention.

Then, a product shown in FIG. 8A that has the same structure as that shown in FIG. 7G is produced by joining the glass substrate 100 to an Si substrate 114 through anode joining or bonding using an adhesive.

Figure 8B:
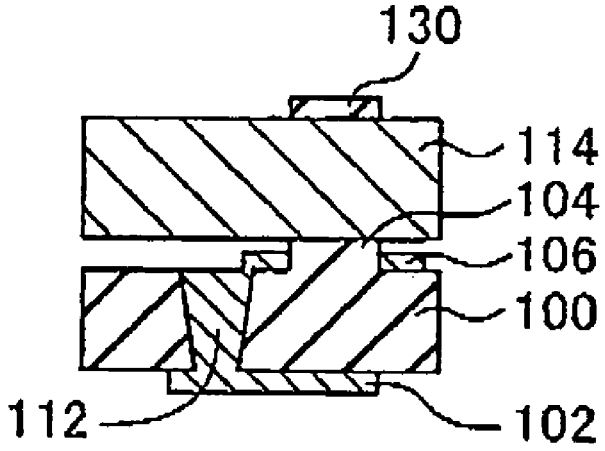

Next, as shown in FIG. 8B, a mask 130 is formed at a position corresponding to the arrangement of the ink guide.

Figure 8C:
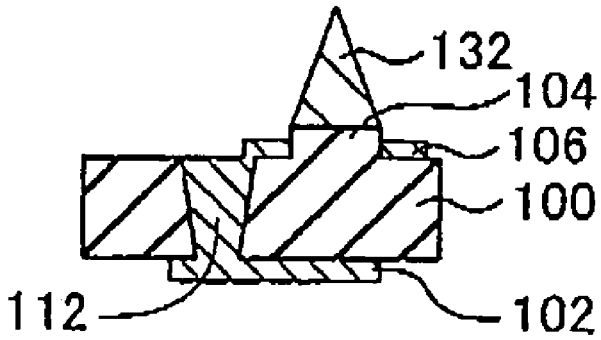

Then, by anisotropically etching the Si substrate 114 using this mask 130 as an etching mask, a pyramidal structural member 132 shown in FIG. 8C whose tip end is sharply pointed and which serves as the ink guide, is formed on a surface of the cylindrical column 104.

Even with this method, it is possible to produce a head-substrate-side structural body including the ink guide whose tip end is sharply pointed, the ejection electrode provided on the head substrate so as to surround the ink guide, the electrode drawing portion for establishing connection with voltage application means for applying a voltage to the ejection electrode, and the wiring portion provided on a surface opposite to the surface on which the ejection electrode of the head substrate has been arranged.

Even in this case, like in the above case, it is possible to produce an ink jet head through assembling where a through-hole substrate including through-holes at positions corresponding to ejection portions is placed at a position spaced apart from the head substrate of the head-substrate-side structural body produced in the manner described above by a predetermined distance.

Adjusting the shapes of the masks, etchant, and the like, makes it possible to eliminate limitation to an ink guide including a tip end portion having a pyramidal structure and a base portion having a columnar structure and produce ink guides having various shapes such as an ink guide having a pyramidal structure.

The liquid ejection head according to the first aspect of the present invention and the liquid ejection head production method according to the fourth aspect are fundamentally constructed in the manner described above.

Next, a liquid ejection head according to a second aspect of the present invention and a liquid ejection head production method according to a fifth aspect of the present invention will be described with reference to FIGS. 9 to 17G.

Figure 9:
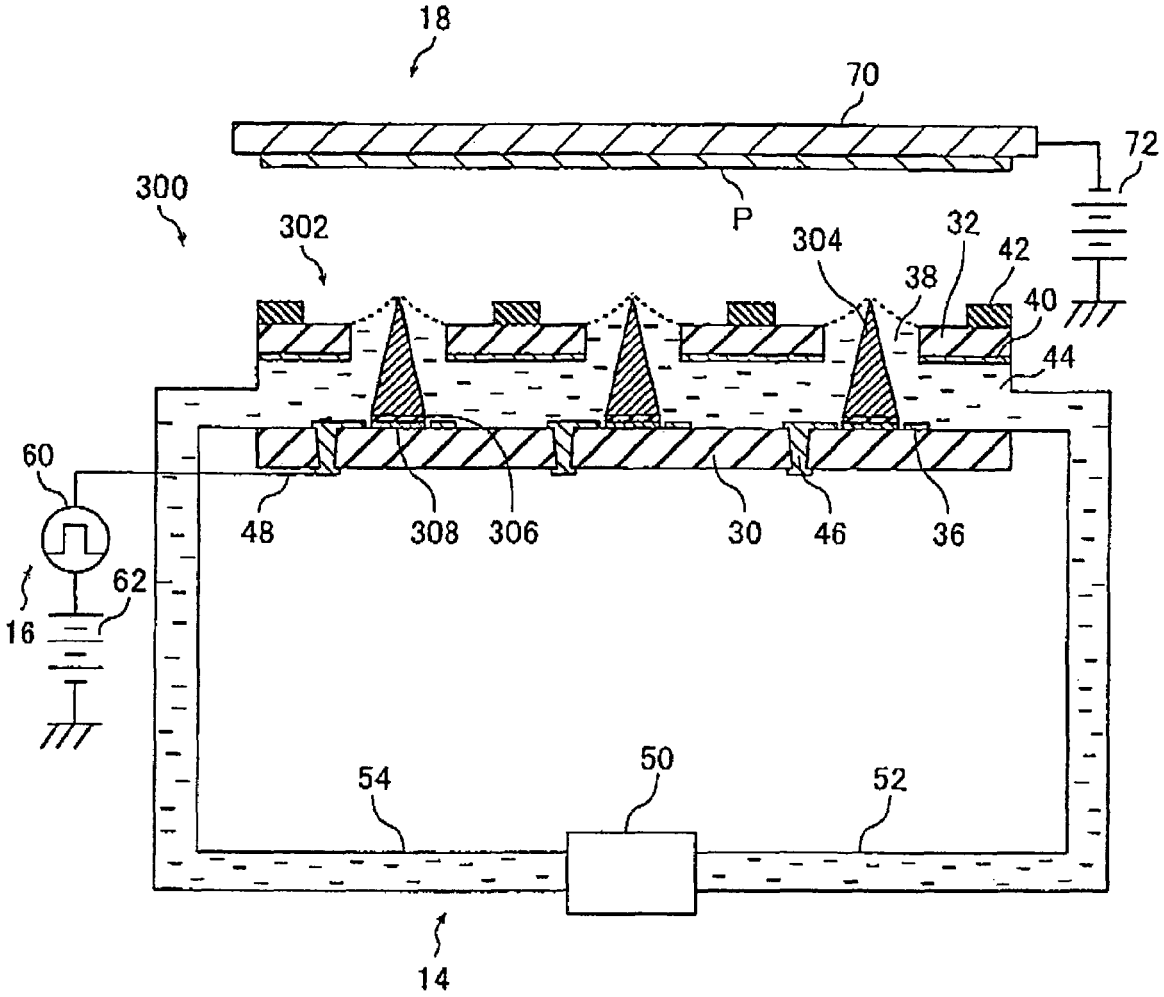
FIG. 9 is a schematic diagram showing an outline construction of still another embodiment of the liquid ejection head according to the present invention.
Figure 10:
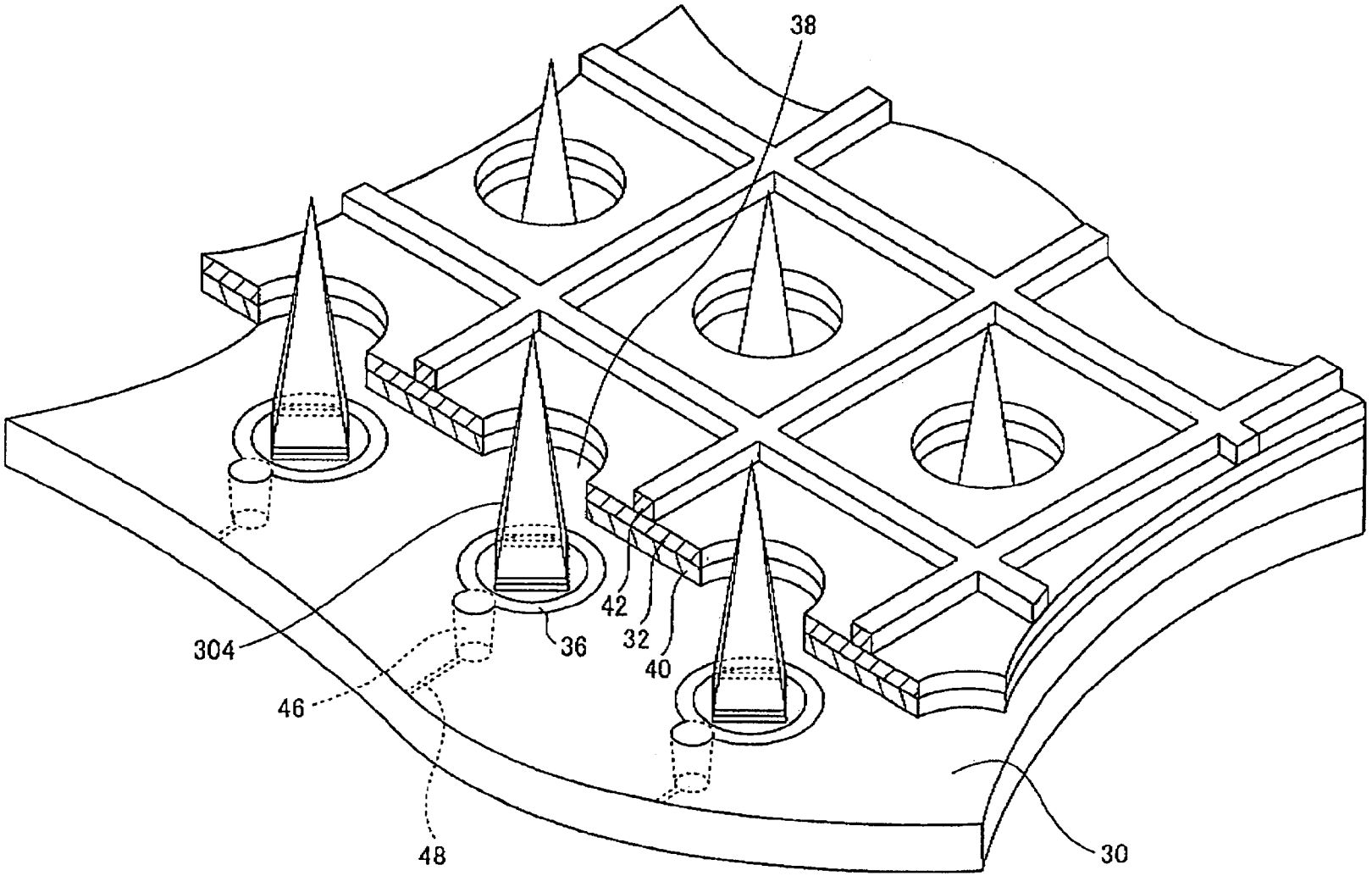
FIG. 10 is an outline perspective view of the liquid ejection head shown in FIG. 9.
Figure 11:
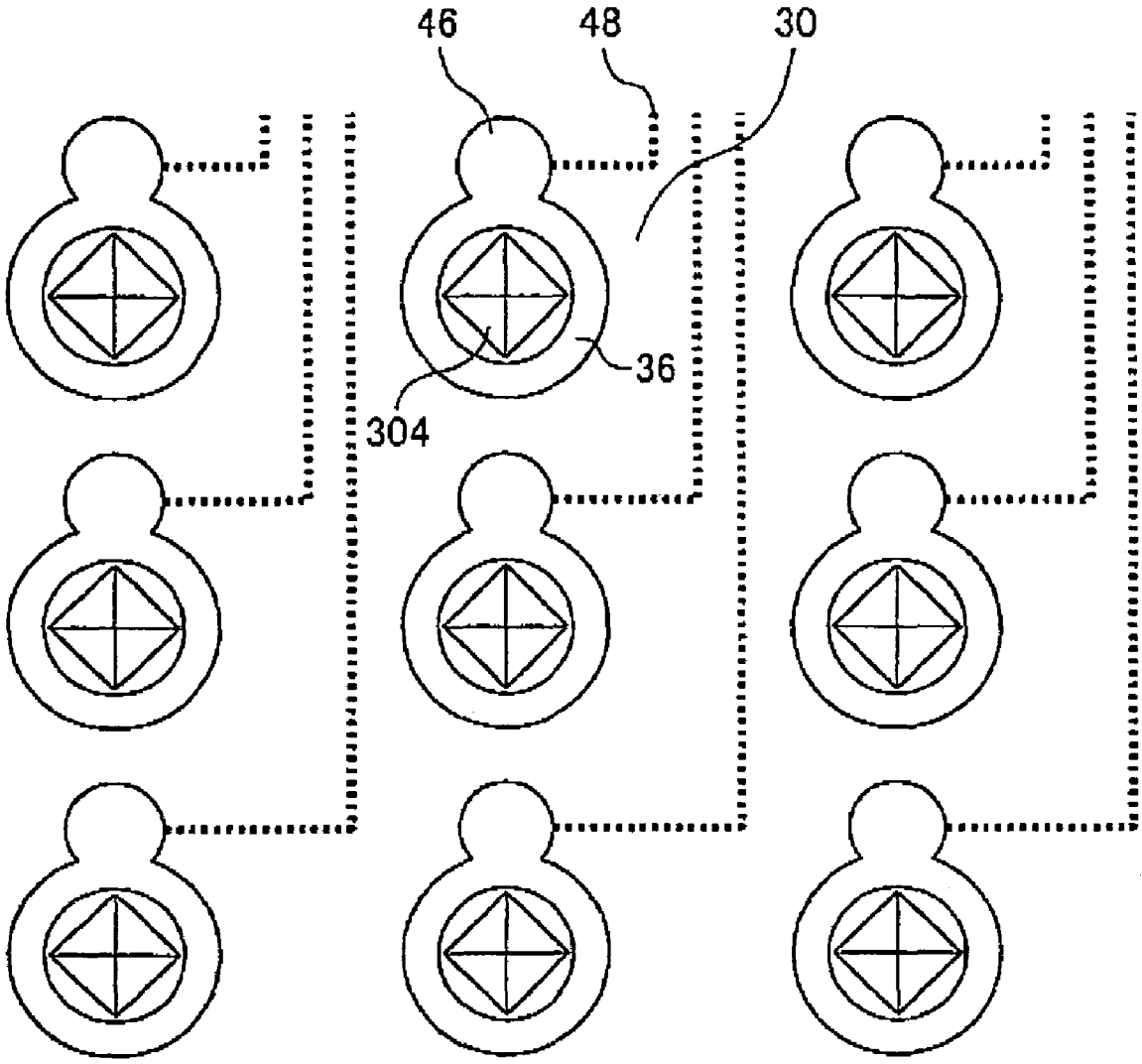
FIG. 11 is a schematic diagram showing an arrangement example of ejection electrodes of the liquid ejection head shown in FIG. 9.

FIG. 9 is a schematic diagram of an embodiment of an ink jet recording apparatus having an ink jet head according to an embodiment of the liquid ejection head according to the second aspect of the present invention. FIG. 10 is a perspective view of the ink jet head shown in FIG. 9. FIG. 11 is a schematic diagram showing an arrangement example of ejection electrodes shown in FIG. 9.

Here, an ink jet recording apparatus 300 shown in FIGS. 9, 10, and 11 has the same construction as the electrostatic ink jet recording apparatus 10 shown in FIGS. 1, 2, and 3 except some portions. Accordingly, in this second aspect, each same construction element as in the first aspect is given the same reference numeral and the detailed description thereof will be omitted. Therefore, in the following description, points unique to the ink jet recording apparatus 300 will be mainly explained.

The ink jet recording apparatus 300 shown in FIG. 9 includes an ink jet head 302, ink circulation means 14, voltage application means 16, and recording medium supporting means 18 arranged at a position opposing the ink jet head 302. That is, the ink jet recording apparatus 300 has a construction where the ink jet head 302 is provided in the ink jet recording apparatus 10 shown in FIG. 1 in place of the ink jet head 12.

The ink jet head 302 shown in FIGS. 9 to 11 according to an embodiment of the liquid ejection head according to the second aspect of the present invention includes a head substrate 30, a through-hole substrate 32, ink guides 304, ejection electrodes (control electrodes) 36, a shield electrode 40, and 3-D barriers 42. That is, the ink jet head 302 has a construction where the ink guides 304 are provided in place of the ink guides 34 in the ink jet head 12 shown in FIGS. 1 to 3 according to an embodiment of the liquid ejection head according to the first aspect of the present invention.

In the ink jet head 302, metallic layers 308 are provided at positions corresponding to through-holes 38 of a surface of the head substrate 30 on a through-hole substrate 32 side and electrical insulation layers 306 are provided on surfaces of the metallic layers 308. In addition, on surfaces of the insulation layers 306, the metal-made ink guides 304 are provided whose tip ends protrude toward recording medium supporting means 18 side from the through-holes 38.

That is, the ink guides 304 of the ink jet head 302 shown in FIGS. 9 to 11 according to an embodiment of the second aspect of the present invention differ from the ink guides 34 of the ink jet head 12 shown in FIGS. 1 to 3 according to an embodiment of the first aspect of the present invention only in shape and arrangement. That is, the ink guides 34 are each an ink guide that has an octagonal pyramidal shape and is directly attached onto the surface of the head substrate 30 but the ink guides 304 are each a metal-made ink guide that has a quadrilateral pyramidal shape and is attached to the surface of the head substrate 30 through the metallic layer 308 and the insulation layer 306 on the metallic layer 308.

Accordingly, construction elements of the ink jet head 302 other than the ink guides 304, that is, the head substrate 30, the through-hole substrate 32, the ejection electrodes (control electrodes) 36, the shield electrode 40, and the 3-D barriers 42 of the ink jet head 302 are the same as those of the ink jet head 12 shown in FIGS. 1 to 3, so the detailed description thereof will be omitted.

In addition, since the ink circulation means 14, the voltage application means 16, a counter electrode 70, and a bias voltage supply 72 of the ink jet recording apparatus 300 are the same as those of the ink jet recording apparatus 10 shown in FIG. 1, the detailed description thereof will be omitted.

Hereinafter, the ink guides 304 of the ink jet head 302 and their related portions will be described in detail.

As shown in FIG. 9, on a surface of the head substrate 30 on a through-hole substrate 32 side, that is, on the upper surface thereof, the metallic layers 308 and the insulation layers 306 are stacked in this order for respective ejection portions and the metal-made ink guides 304 are provided on the insulation layers 306 stacked on the metallic layers 308. Here, the metallic layers 308 and the insulation layers 306 have a shape that is approximately the same as the quadrilateral shape of the bottom surfaces of the quadrilateral pyramidal metal-made ink guides 304. In addition, the ejection electrodes 36 are provided on the head substrate 30 for the respective ejection portions so as to surround the ink guides 304 as well as the metallic layers 308 and the insulation layers 306 that are lower layers of the ink guides 304. At this time, the ejection electrodes 36 are spaced apart from the ink guides 304, the metallic layers 308, and the insulation layers 306 by a predetermined distance, thereby preventing contact therebetween.

By providing the ink guides 304 on the insulation layers 306 like in this embodiment, even when the ink guides 304 are made of a metal, they are placed under an electrical insulated state. The metal-made ink guides are thus provided on the insulation layers 306, and therefore no short circuits occur between the ejection electrodes 36 and the ink guides 304. Also, by providing the metallic layers 308 between the head substrate 30 and the insulation layers 306, it becomes possible to suitably join the insulation layers 306 and the head substrate 30 to each other.

Here, in this embodiment, the insulation layers 306 and the metallic layers 308 are provided, although those layers are not necessarily required in the present invention. That is, the insulation layers 306 may be omitted when it is possible to place the ink guides 304 under the insulated state. Also, the metallic layers 308 may be omitted when the ink guides 304 and the head substrate 30 are joined to each other without using the metallic layers 308.

The metal-made ink guides 304 provided for the head substrate 30 with the metallic layers 308 and the insulation layers 306 therebetween are, for instance, made of a metal, such as Au, Cu, Ni, or Al, and has a polygonal pyramidal shape whose tip end has a sharply pointed convex shape. Meniscuses of ink are formed between the tip end portions of the ink guides 304 and the through-holes 38 and the ink concentrates in the tip end portions of the ink guides 304. When a predetermined voltage is applied to the ejection electrodes 36 under this state, ink droplets are ejected from the tip end portions of the ink guides 304.

In this embodiment, the shape of the ink guides 304 is a quadrilateral pyramid, but the present invention is not limited to this. That is, the shape of the ink guides 304 may be a polygonal pyramid except the quadrilateral pyramid, a cone, or an elliptical cone. In addition, there occurs no problem even when the ink guides 304 do not have a pyramidal or conical shape in their entireties so long as at least the tip end portions of the ink guides 304 are sharply pointed. For instance, the ink guides 304 may have a shape where a cone or a polygonal pyramid whose tip end is sharply pointed, is placed on a cylindrical column or a polygonal column.

Even in this aspect, by forming the tip end portions of the ink guides 304 in a sharply pointed shape, electric fields can concentrate in the tip end portions of the ink guides 304. As a result, it becomes possible to eject ink droplets with stability at a low voltage as compared with the conventional case and to eject minute droplets.

Also, by setting the ink guides 304 as electrically-insulated metal portions, the dielectric constant thereof is substantially increased and it becomes easy to generate a strong electric field, thus improving the ink droplet ejection property.

In this embodiment, it is preferable that the tip end angle of the tip end portions of the ink guides 304 be 120° or less and/or the radius of curvature of the tip end portions be 4 μm or less. In this aspect, it is not required to have the ink guides 304 whose tip ends are so sharply pointed when it is possible to eject droplets from the tip ends of the ink guides with stability at a desired ejection voltage. In order to eject the ink with more stability at a lower ejection voltage, however, it is preferable that the tip end portions of the ink guides be formed so as to have the tip end angle of 120° or less and/or the radius of curvature of 4 μm or less.

The ejection electrodes 36 are arranged on the upper surface of the head substrate 30 (on the surface opposing the through-hole substrate 32) as ring-shaped circular electrodes that surround the connection portions among the ink guides 304, the insulation layers 306, the metallic layers 308, and the head substrate 30. Also, the ejection electrodes 36, the ink guides 304 (including the insulation layers 306 and the metallic layers 308), and the through-holes 38 are arranged so that they become substantially coaxial, that is, the centers thereof approximately coincide with each other. In this embodiment, a construction has been described in which the ejection electrodes 36 are formed on the surface of the head substrate 30 so as to be exposed to the ink flow path. The present invention is not limited to this and the ejection electrodes 36 may be formed inside the head substrate 30 in a positional relation where the ejection electrodes 36 are substantially coaxial with the through-holes 38.

Also, the multiple ink guides 304 and the multiple ejection electrodes 36 are formed integrally with the head substrate 30, and distances between the ink guides 304 and the ejection electrodes 36 become constant. As a result, a drive voltage necessary for ejection is fixed from ejection portion to ejection portion and it becomes possible to eject multiple ink droplets at a high frequency with stability using a low drive voltage generally.

Figure 12:
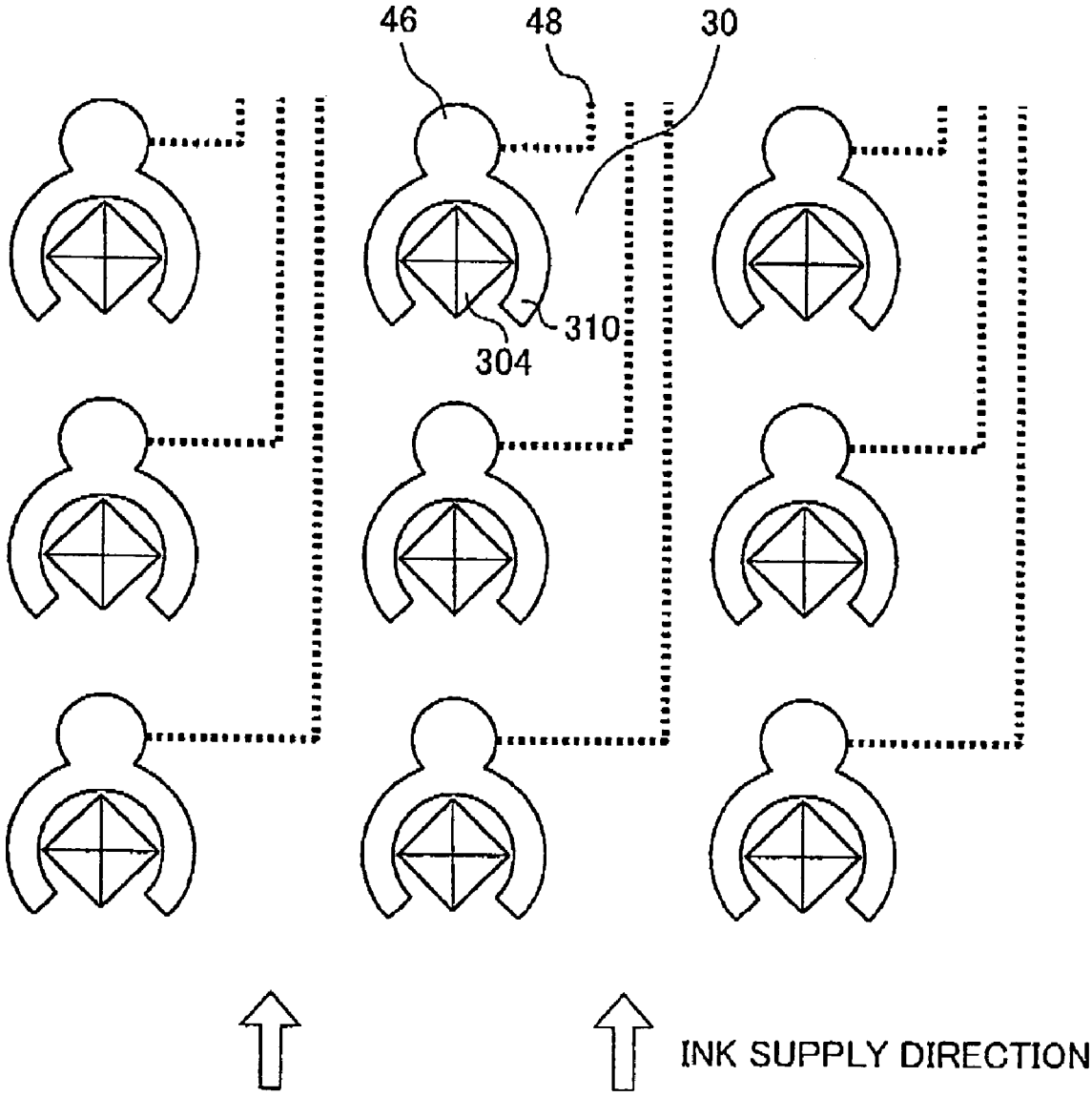
FIG. 12 is a schematic diagram showing another example of the arrangement of the ejection electrodes of the liquid ejection head shown in FIG. 9.

Even in this embodiment, like, for instance, in the case of the ejection electrodes 80 shown in FIG. 4 of the embodiment of the first aspect, a shape is preferably used in which the circular electrodes are partially removed on an ink supply side (ink flow path upstream side) like ejection electrodes 310 shown in FIG. 12. By thus partially removing the ejection electrodes 310 on the ink supply side or the ink flow path upstream side, a repulsive force exerted on ink particles as a result of application of a drive voltage to the ejection electrodes 310 at the time of recording is reduced on the ink supply side. As a result, even at the time of recording, it becomes possible to supply the ink particles to the ink guide 304 with efficiency.

Also, even with the ink jet recording apparatus 300 in this embodiment, it is certainly possible to perform an ink droplet ejection operation and provide the same effects as in the case of the ink jet recording apparatus 10 described above in the embodiment of the first aspect.

Figure 13:
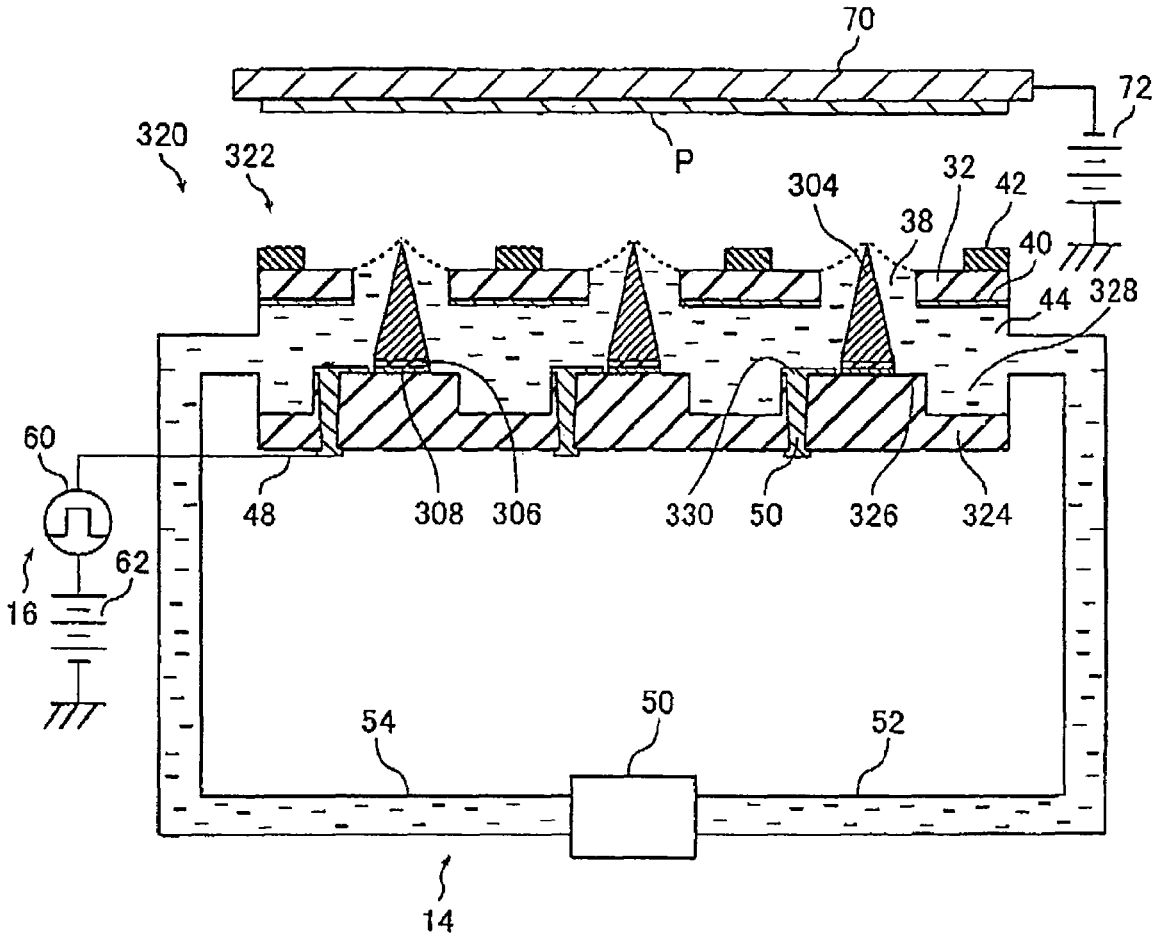
FIG. 13 is a schematic diagram showing an outline construction of yet another embodiment of the liquid ejection head according to the present invention.
Figure 14:
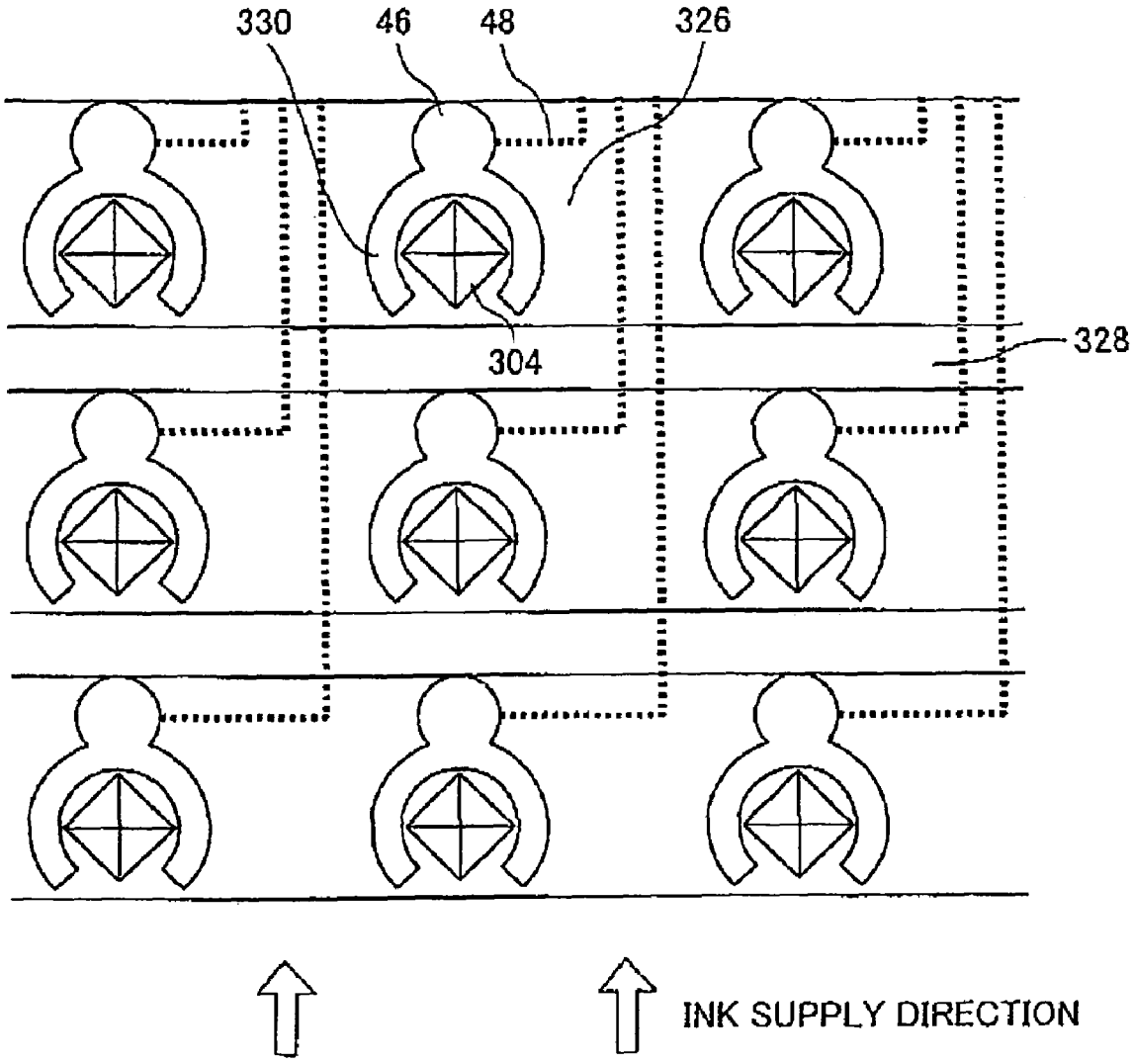
FIG. 14 is a schematic diagram showing an arrangement example of ejection electrodes of the liquid ejection head shown in FIG. 13.

FIG. 13 is a schematic diagram showing an outline construction of an embodiment of an ink jet recording apparatus having an ink jet head of another embodiment of the liquid ejection head according to the second aspect of the present invention. FIG. 14 is a schematic diagram showing an arrangement example of ejection electrodes of the ink jet head of the ink jet recording apparatus shown in FIG. 13. An ink jet recording apparatus 320 shown in FIGS. 13 and 14 has the same construction as the electrostatic ink jet recording apparatus 300 shown in FIGS. 9, 10, and 11 except some portions. Accordingly, in this embodiment, each same construction element is given the same reference numeral and the description thereof will be omitted. Therefore, in the following description, points unique to the ink jet recording apparatus 320 will be mainly explained.

A head substrate 324 of an ink jet head 322 in this embodiment is provided with convex portions 326 common to ejection portions adjacent to each other in a direction orthogonal to an ink flow path (from the right side to the left side in FIG. 13, from the lower side to the upper side in FIG. 14), and ink guides 304 and ejection electrodes 330 are provided on the convex portions 326. In addition, concave portions 328 having a predetermined depth are formed outside the ejection electrodes 330 in a direction orthogonal to the ink flow path. That is, the ejection portions adjacent to each other in the direction orthogonal to the ink flow path are formed on the same convex portion 326, and the concave portions 328 are formed between the ejection portions adjacent to each other in the direction in which the ink flows.

Also, in this embodiment, the ejection electrodes 330 are preferably formed in a shape where they are partially removed on an ink supply side like the ejection electrodes 310 shown in FIG. 12.

With this construction, the convex portions 326 function as leading weirs, and it becomes possible to lead ink in an ink guide 304 tip end direction and supply the ink to the tip end portions of the ink guides 304 with efficiency.

Also, the concave portions 328 are provided, and the area of the ink flow path 44 increases. As a result, the amount of the ink flowing in the ink flow path 44 increases and it becomes possible to supply the ink to the tip end portions of the ink guides 304 with efficiency.

Here, it is possible to say that the convex portions 326 and the concave portions 328 provided for the head substrate 324 of the ink jet head 322 of the ink jet recording apparatus 320 shown in FIGS. 13 and 14 have the same constructions as the convex portions 94 and the concave portions 96 provided for the head substrate 92 of the ink jet head 91 of the ink jet recording apparatus 90 shown in FIGS. 5 and 6 except for the construction of the ink guides. The convex portions 326 and the concave portions 328 have the same functions and effects as the convex portions 94 and the concave portions 96. Therefore, the detailed description of the convex portions 326 and the concave portions 328 will be omitted.

Next, a liquid ejection head production method according to a fifth aspect of the present invention will be described.

FIGS. 15A to 15E are each a schematic diagram showing an embodiment of a method of producing a metal portion serving as an ink guide of an ink jet head that is an example of the liquid ejection head according to the second aspect of the present invention. FIG. 16 is a perspective view schematically showing the shape of concave portions formed in an Si substrate. FIGS. 17A to 17G are each a schematic diagram showing an embodiment of an ink jet head production method that is an example of the liquid ejection head production method according to the fifth aspect of the present invention where the ink guide produced in the manner shown in FIGS. 15A to 15E is used.

Figure 15A:
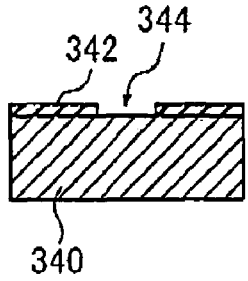
FIGS. 15A to 15E are each an outline diagram illustrating another embodiment of the liquid ejection head production method according to the present invention.
Figure 16:
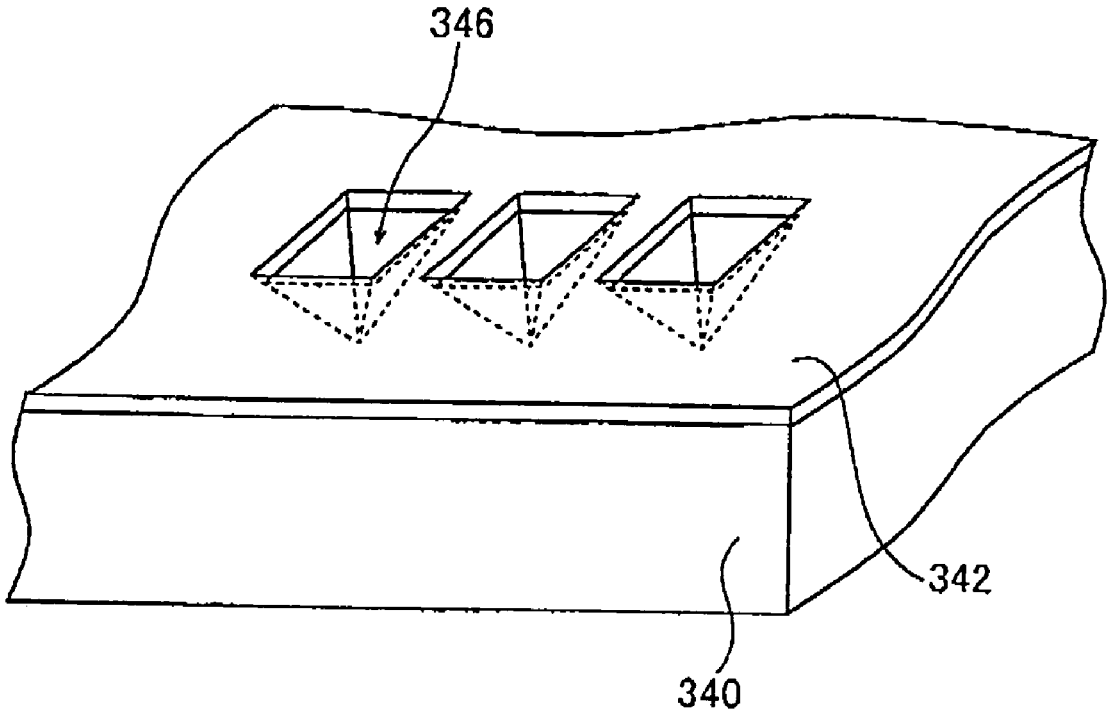
FIG. 16 is an outline perspective view showing a shape of concave portions formed through anisotropic etching of a single crystal substrate shown in FIG. 15B.

First, as shown in FIG. 15A, an electrical insulation film 342 is formed on a <100> plane of an Si substrate 340 that is a single crystal substrate having the <100> plane as a surface. Then, a square opening portion 344 whose sides coincide with the <110> and <1-10> orientations of the crystalline plane of the Si substrate 340, is produced in the insulation film 342 using a lithography method or the like so as to correspond to arrangement of an ink guide.

Figure 15B:
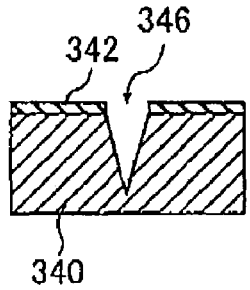

Next, anisotropic etching of the Si substrate 340 is performed using, for instance, a 34 wt % aqueous solution of KOH heated to 70° C. by using the insulation film 342 having the opening portion 344 as an etching mask. As a result of the etching, as shown in FIGS. 15B and 16, a concave portion 346 whose cross section has an substantially quadrilateral pyramidal shape, is formed in the Si substrate 340. Producing the concave portion 346 makes it possible to form the concave portion in a shape having a sharpened end portion whose base portion angle is around 120° or less and/or whose radius of curvature is 4 μm or less.

Figure 15C:
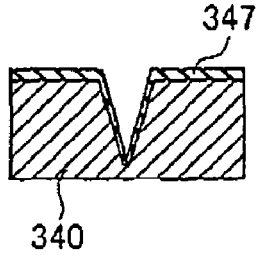

Next, as shown in FIG. 15C, the insulation film 342 is removed and another electrical insulation film 347 is newly formed on a surface of the Si substrate 340 including the concave portion 346. As a result, the insulation film 347 is formed also for the inner surface of the concave portion 346.

Figure 15D:
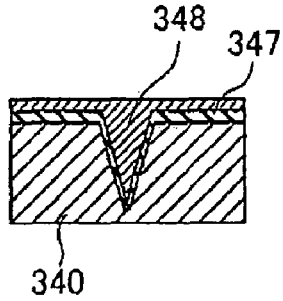

Next, as shown in FIG. 15D, a metal portion 348 is formed on the surface of the Si substrate 340 including the concave portion 346 through plating or the like. As a result, a metal is filled into the concave portion 346. Here, the plating is not the sole method of forming the metal portion 348 and the metal portion 348 may be formed through soldering or the like.

Next, the metal portion 348 is removed except a part of the metal portion 348 filled into the concave portion 346, that is, a quadrilateral pyramidal part (hereinafter referred to as the "metal portion 348*a*") of the metal portion 348. Then, an electrical insulation film is formed on the surface of the Si substrate 340 including the concave portion 346 through CVD or the like, a surface of the insulation film corresponding to the metal portion 348*a* is masked using a lithography method, the formed mask serves as an etching mask, and the insulation film is etched except its part corresponding to the metal portion 348*a*, thereby forming an electrical insulation layer 350 on a surface of the metal portion 348*a*.

Then, a metallic film is formed on the surface of the Si substrate 340 including the concave portion 346 through evaporation or the like and is removed except its part above the metal portion 348*a* using, for instance, a lithography method and etching, thereby forming a metallic layer 352 on the insulation layer 350.

Figure 15E:
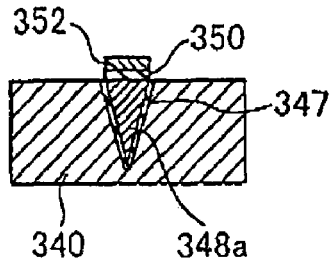

In this manner, as shown in FIG. 15E, the convex metal portion 348*a* serving as an ink guide is formed at a position corresponding to arrangement of the ink guide of the Si substrate 340, the insulation layer 350 is formed on a surface (surface serving as a bottom surface of the ink guide) of the metal portion 348*a*, and the metallic layer 352 is further formed on a surface of the insulation layer 350.

Here, in this embodiment, the concave portion for forming the ink guide is produced using an Si substrate. The present invention is not limited to this and any other single crystal substrate may be used so long as anisotropic etching of the single crystal substrate can be performed.

Next, an ink jet head production method in this embodiment will be described with reference to FIGS. 17A to 17G.

Here, only one ejection portion is illustrated in FIGS. 17A to 17G, although it is also possible to produce two-dimensionally disposed ejection portions at the same time with the production method in this embodiment.

Also, in this embodiment, a glass substrate 360 is used as an example of a substrate that has an electrical insulation property and serves as a head substrate.

Figure 17A:
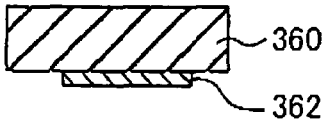
FIGS. 17A to 17G are each an outline diagram illustrating still another embodiment of the liquid ejection head production method according to the present invention.

First, a metallic film is evaporated onto the glass substrate 360, a mask corresponding to an electrode pattern of a wiring portion is formed on the metallic film with a lithography method or the like, and the metallic film is etched using the formed mask as an etching mask, thereby forming an electrode 362 serving as the wiring portion on the glass substrate 360 as shown in FIG. 17A. Here, a method for evaporating the metallic film is not specifically limited and it is sufficient that the metallic film is evaporated using a conventionally known technique such as sputtering or CVD.

Figure 17B:
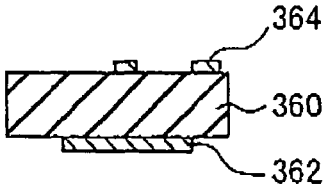

A metallic film is evaporated on a surface opposite to the surface of the glass substrate 360 on which the electrode 362 has been formed, through sputtering or the like and then a mask is produced with a lithography method or the like. Here, the mask in this embodiment is a ring-shaped mask with which the metallic film is exposed to the outside except its part that will become an ejection electrode. Through etching the metallic film using the mask as an etching mask, a ring-shaped electrode 364 serving as an ejection electrode is formed as shown in FIG. 17B.

Here, it is also possible to form the electrodes shown in FIG. 12, which are partially removed, by forming the mask in a shape where a part of a ring shape is removed and etching the metallic film using the mask as an etching mask.

Figure 17C:
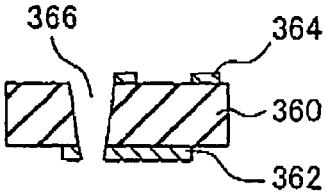

Next, as shown in FIG. 17C, a through-hole 366 is formed in the glass substrate 360 so that the electrode 362 and the ring-shaped electrode 364 form some portions of the inner wall surface of the through-hole 366. By thus forming the through hole 366, the electrode 362 and the electrode 364 are partially exposed to the side surface of the through-hole 366.

It is sufficient that the through-hole 366 is formed using a conventionally known technique such as sand blasting or laser beam machining. Also, the through-hole 366 is preferably formed in a tapered shape where the through-hole 366 is gradually narrowed as a distance to a surface on which the electrode 362 is formed is decreased.

Figure 17D:
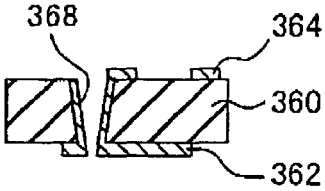

Next, for continuity between the electrode 362 and the electrode 364 on both surfaces of the glass substrate 360, a metallic film is evaporated on the side surface of the through-hole 366, thereby forming an electrode 368 on the side surface of the through-hole 366 as shown in FIG. 17D. At this time, in order to prevent the metallic film from being evaporated on portions other than the side surface of the through-hole 366, a resist layer that will become a mask may be formed in portions where the metallic film is not to be evaporated.

Figure 17E:
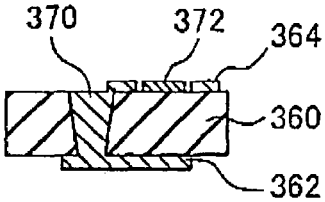

Then, a metal is filled into the through-hole 366 and is caused to adhere at a position corresponding to arrangement of an ink guide on a surface of the glass substrate 360 on which the electrode 364 has been formed, by performing plating such as electroplating. As a result, as shown in FIG. 17E, a plated portion 370 serving as a drawing portion is formed so as to be embedded in the through-hole 366 and a metallic layer 372 is formed at the position corresponding to the arrangement of the ink guide. Here, as the metal used to perform the plating, various metals are usable and, in particular, a metal such as Au, Cu, or Ni which will never be corroded even when the metal contact the ink is preferably used.

Even in this case, it is also possible to form a resist layer serving as a mask in parts in which plating is not to be performed, so that the plating will not be performed in parts other than the through-hole 366 and the position corresponding to the arrangement of the ink guide on the surface of the glass substrate 360 on which the electrode 364 has been formed.

Also, it is not required to perform the plating for the position corresponding to the arrangement of the ink guide and the plating for the through-hole at the same time. Those platings may be performed separately.

Figure 17F:
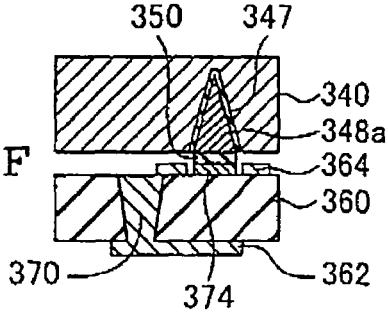

Next, as shown in FIG. 17F, a metallic layer 374 is formed through diffused junction of the metallic film 372 of the glass substrate 360 and the metallic layer 352 of the Si substrate 340 shown in FIG. 15E. Here, it is possible to join the metallic film 372 and the metallic layer 352 at 300° C. or less by performing the diffused junction using, for instance, a metal containing Sn or the like in a metallic layer.

It should be noted here that the method of joining the metallic layer 352 of the Si substrate 340 and the metallic film 372 of the glass substrate 360 to each other is not limited to the diffused junction and it is possible to use other conventionally known techniques such as soldering.

Figure 17G:
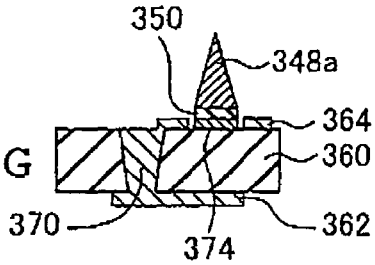

Next, by removing the Si substrate 340 and then removing the insulation film 347 using etchant such as an aqueous solution of KOH, it is possible to produce a metal portion 348*a* shown in FIG. 17G serving as an ink guide whose tip end portion has a tip end angle of 120° or less and/or has a radius of curvature of 4 μm or less, for the glass substrate 360.

With the method described above, it is possible to produce a head substrate including the ink guide which is made of a metal and whose tip end is sharply pointed, the ejection electrode provided on the head substrate so as to surround the ink guide, the electrode drawing portion for establishing connection with voltage application means for applying a voltage to the ejection electrode, and the wiring portion provided on a surface opposite to the surface on which the ejection electrode of the head substrate has been arranged.

Even in this case, it is possible to produce an ink jet head through assembling where a through-hole substrate including through-holes at positions corresponding to ejection portions is further placed at a position spaced apart from the head substrate of the head-substrate-side structural body produced in the manner described above by a predetermined distance.

By thus manufacturing a liquid ejection head using, for instance, lithography and etching of a semiconductor manufacturing method, it becomes possible to produce a metallic ink guide and an ejection electrode having high reliability and high accuracy. As a result, it becomes possible to produce an ink jet head at a low cost.

Also, by producing ink guides in the manner described above, an ink guide can be produced whose tip end is sharply pointed, using a metal with high accuracy.

The ink guide having inclined surfaces of a high-order polyhedron is not the sole ink guide that can be produced in the above embodiment and it is possible to produce ink guides having various shapes.

Also, at the time of production of the ink jet head, alignment marks are preferably formed at predetermined positions of the single crystal substrate, the glass substrate, the metallic layer, and the like and alignment is performed with reference to the alignment marks. Performing the alignment using the alignment marks makes it possible to form the ink guides on the head substrate without causing positional displacements.

The liquid ejection head according to the second aspect of the present invention and the liquid ejection head production method according to the fifth aspect are fundamentally constructed in the manner described above.

Next, a liquid ejection head according to a third aspect of the present invention and a liquid ejection head production method according to a sixth aspect of the present invention will be described with reference to FIGS. 18 to 24C.

Figure 18:
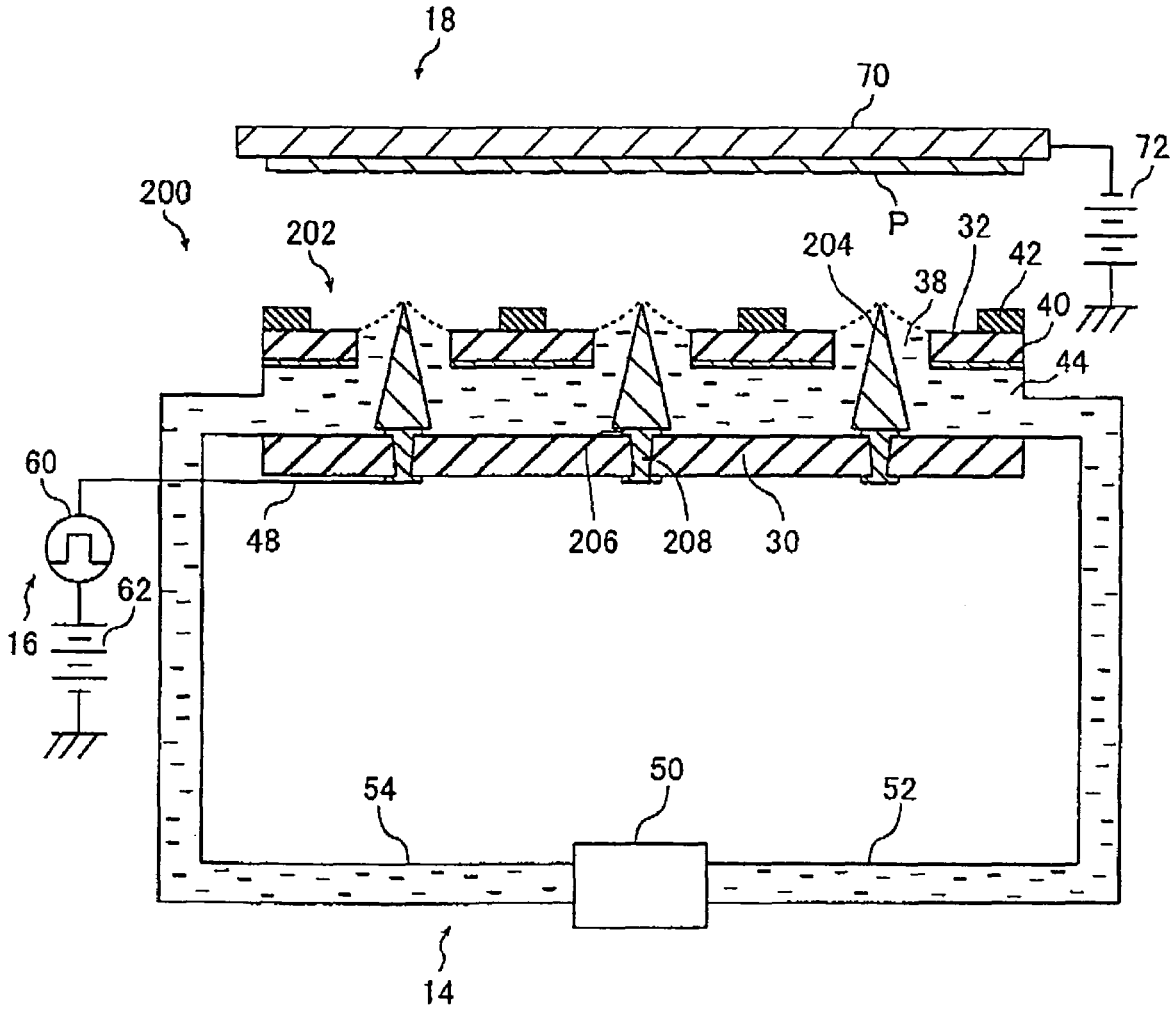
FIG. 18 is a schematic diagram showing an outline construction of still yet another embodiment of the liquid ejection head according to the present invention.
Figure 19:
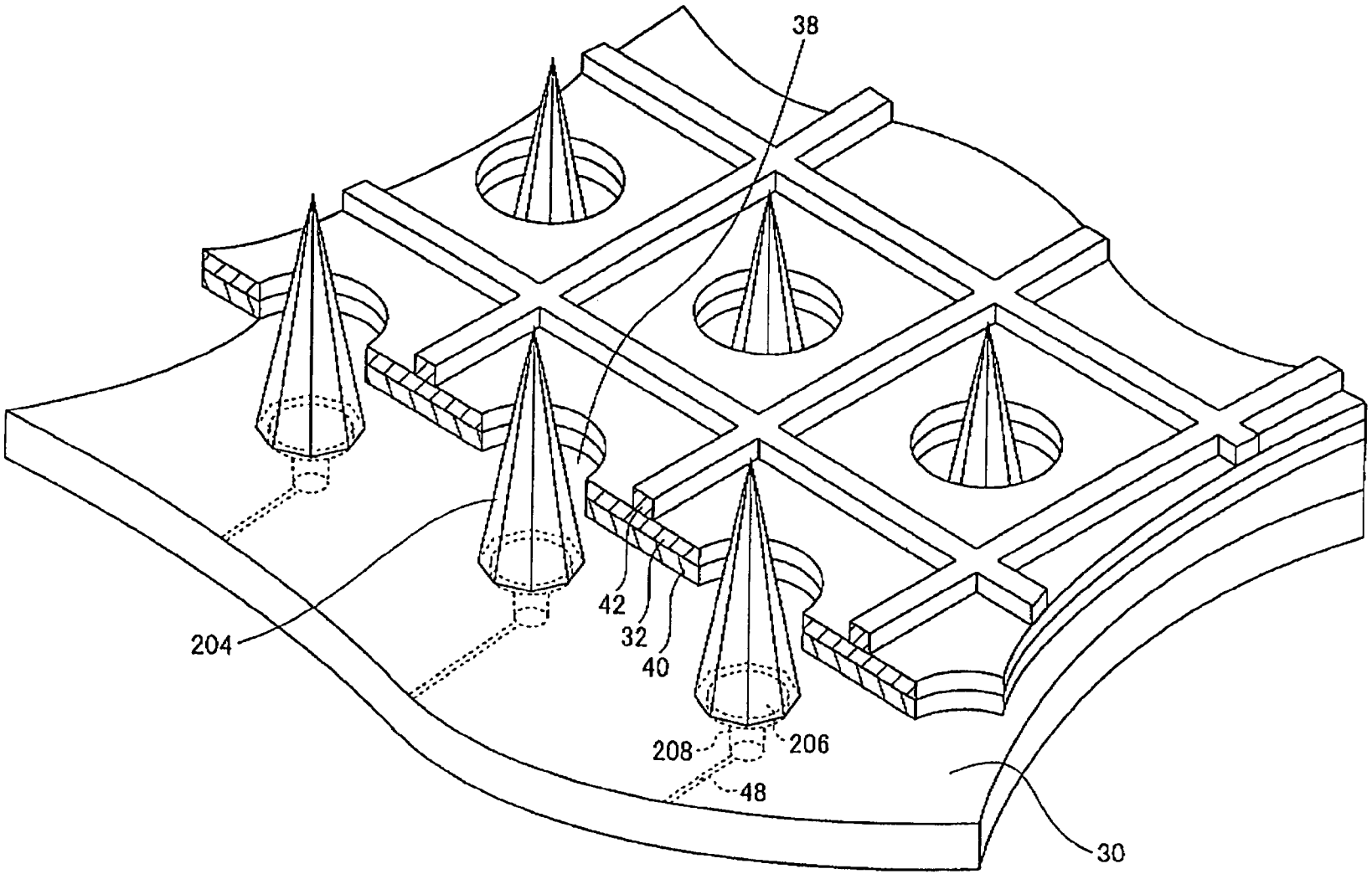
FIG. 19 is an outline perspective view of the liquid ejection head shown in FIG. 18.
Figure 20:
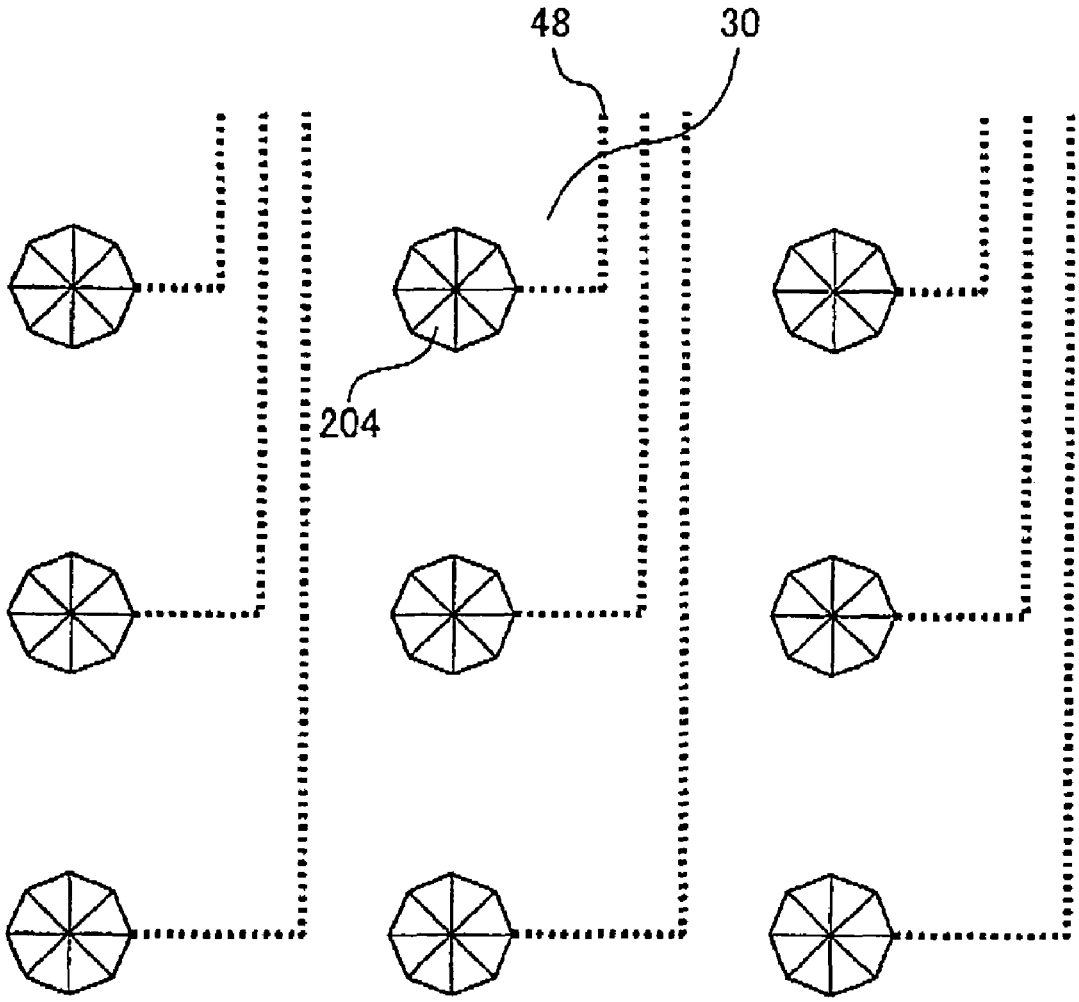
FIG. 20 is a schematic diagram showing an arrangement example of ink guides of the liquid ejection head shown in FIG. 18.

FIG. 18 is a schematic diagram of an embodiment of an ink jet recording apparatus including an ink jet head according to an embodiment of the liquid ejection head according to the third aspect of the present invention. FIG. 19 is a perspective view of the ink jet head shown in FIG. 18. FIG. 20 is a schematic diagram showing an arrangement example of ejection electrodes shown in FIG. 18.

Here, an ink jet recording apparatus 200 shown in FIGS. 18, 19, and 20 has the same construction as the electrostatic ink jet recording apparatus 10 shown in FIGS. 1, 2, and 3 except some portions. Accordingly, in this embodiment, each same construction element is given the same reference numeral and the detailed description thereof will be omitted. Therefore, in the following description, points unique to the ink jet recording apparatus 200 will be mainly explained.

As shown in FIG. 18, the ink jet recording apparatus 200 includes an ink jet head 202, ink circulation means 14, voltage application means 16, and recording medium supporting means 18 arranged at a position opposing the ink jet head 202. That is, the ink jet recording apparatus 200 has a construction where the ink jet head 202 is provided in the ink jet recording apparatus 10 shown in FIG. 1 in place of the ink jet head 12.

The ink jet head 202 shown in FIGS. 18 to 20 according to an embodiment of the liquid ejection head according to the third aspect of the present invention includes a head substrate 30, a through-hole substrate 32, ink guides 204, ejection electrodes 206, electrode drawing portions 208, a wiring portion 48, a shield electrode 40, and 3-D barriers 42. That is, the ink jet head 202 has a construction where the ink guides 204, the ejection electrodes 206, and the electrode drawing portions 208 are provided in place of the ink guides 34, the ejection electrodes 36, and the electrode drawing portions 46 in the ink jet head 12 shown in FIGS. 1 to 3 according to an embodiment of the liquid ejection head according to the first aspect of the present invention.

In the ink jet head 202, the ejection electrodes 206 are provided at positions corresponding to through-holes 38 of a surface of the head substrate 30 on a through-hole substrate 32 side. In addition, on the upper surfaces of the ejection electrodes 206 on the through-hole substrate side, the ink guides 204 are provided whose tip ends protrude toward recording medium supporting means 18 side from the through-holes 38.

Also, the ejection electrodes 206 are connected to the voltage application means 16 through the electrode drawing portions 208 and the wiring portion 48. Here, the electrode drawing portions 208 are provided so as to pass through the head substrate 30 and are connected to the ejection electrodes 206, and the wiring portion 48 is provided on a surface of the head substrate 30 on a side opposite to an ink flow path 44 side.

That is, the ink jet head 202 shown in FIGS. 18 to 20 according to an embodiment of the third aspect of the present invention differs from the ink jet head 12 shown in FIGS. 1 to 3 according to an embodiment of the first aspect of the present invention only in shape and arrangement of the ink guides, the control electrodes, and the electrode drawing portions. That is, in the ink jet head 12, the ink guides 34 are directly attached onto a surface of the head substrate 30, the ring-shaped control electrodes 36 are provided on the surface of the head substrate 30 so as to surround the ink guides 34, and the electrode drawing portions 46 are provided at positions contacting or overlapping the ring-shaped control electrodes 36 so as to pass through the head substrate 30. In contrast to this, in the ink jet head 202, the ejection electrodes 206 are provided on a surface of the head substrate 30 at positions where the ink guides 204 correspond to the through-holes 38, the ink guides 204 are provided on the upper surfaces (surfaces on a through-hole substrate 32 side) of the ejection electrodes 206, and the electrode drawing portions 208 that pass through the head substrate 30 are provided on the lower surfaces of the ejection electrodes 206.

Accordingly, construction elements of the ink jet head 202 except the ink guides 204, the ejection electrodes 206, the electrode drawing portions 208, and positions where the electrode drawing portions 208 pass through the head substrate 30 are the same as those of the ink jet head 12 shown in FIGS. 1 to 3. That is, the head substrate 30, the through-hole substrate 32, the shield electrode 40, the 3-D barriers 42, and the wiring portion 48 of the ink jet head 202 are the same as those of the ink jet head 12 shown in FIGS. 1 to 3. Thus, the detailed description thereof will be omitted.

In addition, the ink circulation means 14, the voltage application means 16, a counter electrode 70, and a bias voltage supply 72 of the ink jet recording apparatus 200 are the same as those of the ink jet recording apparatus 10 shown in FIG. 1, so the detailed description thereof will be omitted.

Hereinafter, the ink guides 204 and their related portions of the ink jet head 202 will be described in detail.

As shown in FIG. 18, the ejection electrodes 206 are provided for respective ejection portions on a surface of the head substrate 30 on a through-hole substrate 32 side and the ink guides 204 are attached to the upper surfaces of the ejection electrodes 206. Here, the head substrate 30 is made of an electrical insulative material such as glass or $SiO_2$.

The ejection electrodes 206 are arranged between the upper surface (surface on a side opposing the through-hole substrate 32) of the head substrate 30 and the bottom surfaces (surfaces on a head substrate 30 side) of the ink guides 204. Also, the ink guides 204, the ejection electrodes 206, and the through-holes 38 of the through-hole substrate 32 are arranged so that they become substantially coaxial, that is, the centers thereof approximately coincide with each other.

Here, in the ink jet head 202 of this embodiment, the ejection electrodes 206 are arranged between the head substrate 30 and the ink guides 204, so it becomes possible to cause only electric fields generated from the upper surfaces of the ejection electrodes 206 to act on ink particles. That is, no electric field that prevents concentration of the ink particles exists at the through-holes 38, so it becomes possible to cause the ink particles to be concentrated in the through-holes 38 swiftly.

Also, arranging the ejection electrodes 206 below the bottom surfaces of the ink guides 204 makes it possible to cause the electric fields to be concentrated in the tip end portions of the ink guides. As a result, it becomes possible to reduce a voltage applied in order to cause ink droplets to be ejected.

Further, the multiple ink guides 204 and the multiple ejection electrodes 206 are formed integrally with the head substrate 30, so distances between the ink guides 204 and the ejection electrodes 206 become constant. Thus, the distance between the ink guide 204 and the ejection electrode 206 is fixed from ejection portion to ejection portion. Therefore, a drive voltage necessary for ejection is fixed from ejection portion to ejection portion and it becomes possible to eject multiple ink droplets at a high frequency with stability using a low drive voltage generally.

It should be noted here that the ejection electrodes are not limited to the circular electrode and it is possible to use other electrodes in various shapes such as a polygonal electrode corresponding to the shape of the bottom surfaces of the ink guides and a ring-shaped electrode. However, an electrode having a shape where no hole exists, such as a circular electrode or a polygonal electrode, is preferably used.

As shown in FIG. 25, a ring-shaped electrode is generally used as the ejection electrodes. In the present invention, however, the ejection electrodes are arranged between the head substrate and the ink guides, so an electrode having a shape where no hole exists can be used. Using the electrode in the shape including no hole as the ejection electrodes makes it possible to produce the ejection electrodes with more ease because machining such as punching becomes unnecessary.

Also, in this embodiment, the ejection electrodes are formed in such a size that they are hidden behind the ink guides, that is, the ejection electrodes are formed smaller than the bottom surfaces of the ink guides. The present invention is not limited to this and the ejection electrodes may be formed in any other size. For instance, the ejection electrodes may be formed larger than the bottom surfaces of the ink guides.

The ink guides 204 are attached onto surfaces of the ejection electrodes 206 on a through-hole substrate 32 side and have a polygonal pyramidal shape whose tip end has a sharply pointed convex shape. Meniscuses of ink are formed between the tip end portions of the ink guides 204 and the through-holes 38 and the ink is supplied to the tip end portions of the ink guides 204. When a predetermined voltage is applied to the ejection electrodes 206 under this state, ink droplets are ejected from the tip end portions of the ink guides 204.

In this embodiment, like in the case of the ink guides 34 in the embodiment shown in FIG. 2, the shape of the ink guides 204 is an octagonal pyramid. The present invention is not limited to this. That is, the shape of the ink guides 204 may be changed to a polygonal pyramid except the octagonal pyramid or to a cone or an elliptical cone. In addition, the ink guides 204 do not have to be in a pyramidal or conical shape in their entireties so long as at least the tip end portions of the ink guides 204 are sharply pointed. For instance, a shape may be used in which a cone or a polygonal pyramid whose tip end is sharply pointed, is placed on a cylindrical column or a polygonal column.

Also in this aspect, forming the tip end portions of the ink guides 204 in the sharply pointed shape makes it possible to cause electric fields to be concentrated at the tip end portions of the ink guides 204. As a result, it becomes possible to eject ink droplets with stability at a low voltage as compared with a conventional case. In addition, minute droplets can be ejected.

In this embodiment, it is preferable that the tip end angle of the tip end portions of the ink guides 204 be 60° or less and/or the radius of curvature of the tip end portions be 4 μm or less. In the present invention, if droplets can be stably ejected from the ink guide tip ends at a desired ejection voltage, it is not required to have the ink guides 204 whose tip ends are so sharply pointed. However, in order to eject the ink more stably at a lower ejection voltage, it is preferable that the tip end angle of the tip end portions of the ink guides be 60° or less and/or the radius of curvature of the tip end portions be 4 μm or less.

Here, the surface of each ink guide 204 may be coated with a conductive film made of a metal or the like in a partial region thereof containing an extreme tip end portion. When such a conductive film is formed for the extreme tip end portion, the dielectric constant of the tip end portion is substantially increased, so it becomes easy to generate a strong electric field and possible to improve the ink droplet ejection property.

Also, the ink guides 204 preferably have conductivity.

As described above, the ink guides 204 are arranged on the ejection electrodes 206. When the ink guides 204 are made conductive, the ink guides 204 and the ejection electrodes 206 have the same potential. As a result, the ink guides 204 substantially serve as ejection electrodes and concentration of electric fields at the tip end portions of the ink guides 204 becomes easy, thereby ejecting ink droplets at a lower voltage.

Also, the ink guides 204 are preferably made of a semiconductor, such as Si, GaAs, or InP, whose electric conductivity is in a range of $10^{-2}$ S/m to $10^{6}$ S/m. In particular, the ink guides 204 are preferably made of Si. Producing the ink guides 204 using a semiconductor, in particular, Si in this manner makes it possible to obtain ink guides having high conductivity with ease using a production method to be described later.

Here, the electric conductivity of Si can be adjusted by, for instance, mixing various substances into Si, and the present invention is not limited to the range described above and it is possible to produce ink guides having various electric conductivity values with ease using Si.

The electrode drawing portions 208 are made of a conductive material, such as a metal, and are provided so as to pass through the head substrate 30 from the lower surfaces of the ejection electrodes 206. Surfaces of the electrode drawing portions 208 on a head substrate 30 back surface side (surface of the head substrate 30 opposite to an ink flow path 44 side) contact the wiring portion 48 and the electrode drawing portions 208 electrically connect the ejection electrodes 206 and the wiring portion 48 to each other.

Here, the shape and position of the electrode drawing portions 208 are not limited so long as the electrode drawing portions 208 electrically connect the ejection electrodes 206 and the wiring portion 48 to each other. For instance, the electrode drawing portions 208 may be arranged so that some portions of surfaces of the electrode drawing portions 208 on the ink flow path 44 side become contact surfaces with the ejection electrodes 206.

Also, the ink jet recording apparatus 200 in this embodiment can perform an ink droplet ejection operation and provide the same effects as in the case of the ink jet recording apparatus 10 described above in the embodiment of the first aspect.

In particular, in this embodiment, the ejection electrodes are provided on the head substrate and the ink guides whose tip ends are sharply pointed, are provided on surfaces of the ejection electrodes, thereby ejecting ink droplets with stability at high speed through low-voltage driving and form a high-quality image at a low cost.

Figure 21:
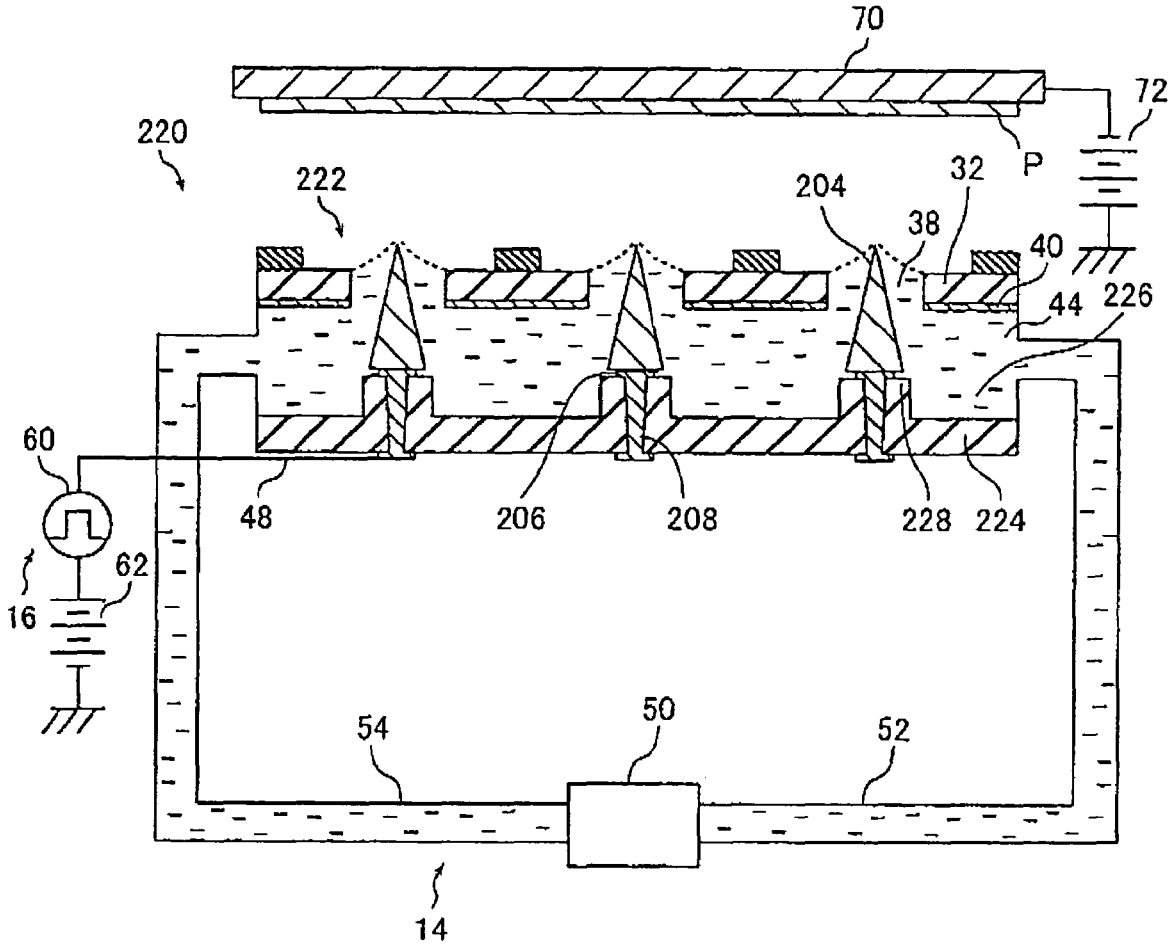
FIG. 21 is a schematic diagram showing an outline construction of another embodiment of the liquid ejection head according to the present invention.
Figure 22:
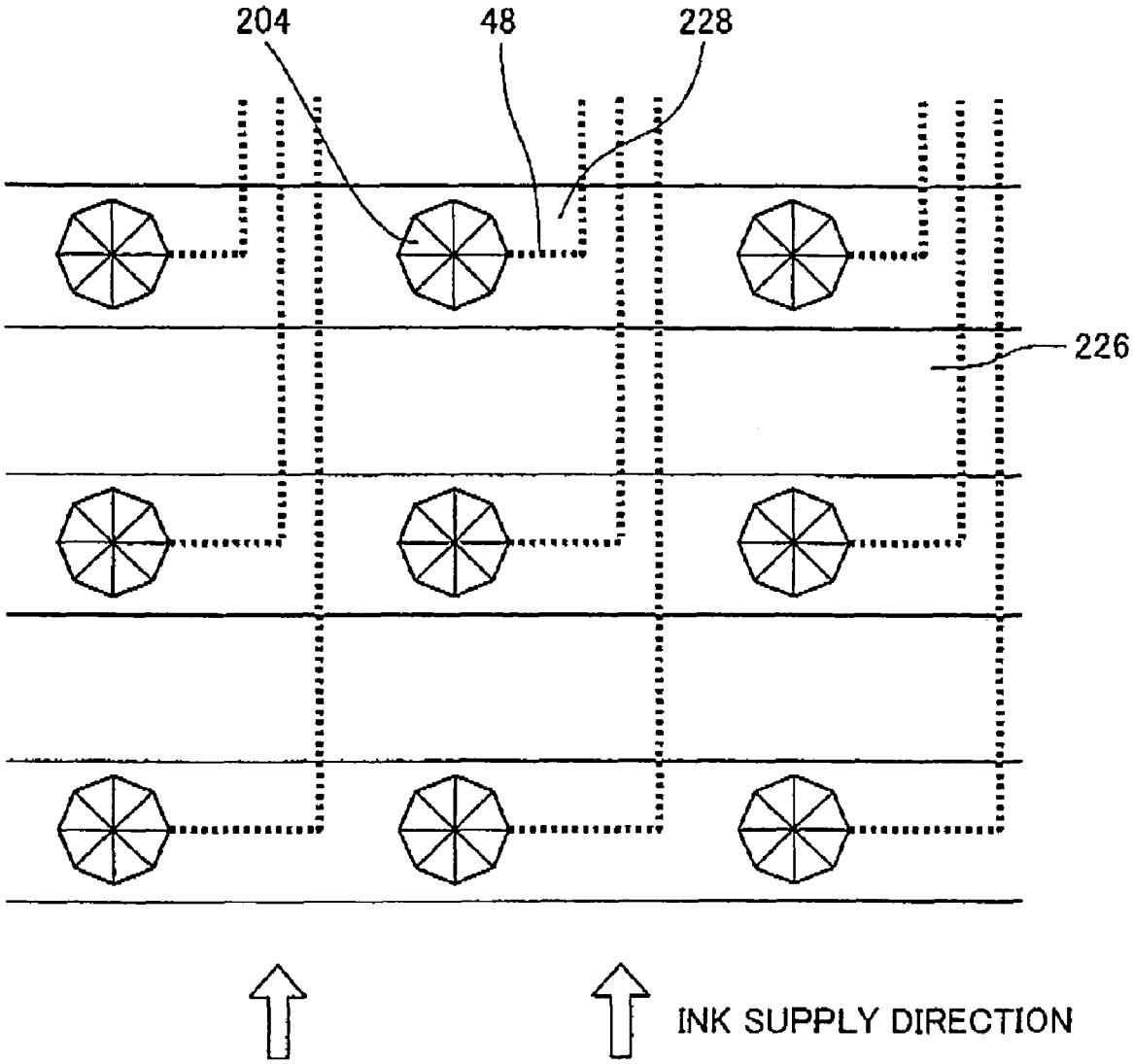
FIG. 22 is a schematic diagram showing an arrangement example of ink guides and grooves of the liquid ejection head shown in FIG. 21.

FIG. 21 is a schematic diagram showing an outline construction of an embodiment of an ink jet recording apparatus having an ink jet head according to another embodiment of the liquid ejection head according to the third aspect of the present invention. FIG. 22 is a schematic diagram showing an arrangement example of ejection electrodes of the ink jet head of the ink jet recording apparatus shown in FIG. 21. An ink jet recording apparatus 220 shown in FIGS. 21 and 22 has the same construction as the electrostatic ink jet recording apparatus 200 shown in FIGS. 18, 19, and 20 except some portions. Accordingly, in this embodiment, each same construction element is given the same reference numeral and the description thereof will be omitted. Therefore, in the following description, points unique to the ink jet recording apparatus 220 will be mainly described.

A head substrate 224 of an ink jet head 222 in this embodiment is provided with convex portions 228 common to ejection portions adjacent to each other in a direction orthogonal to an ink flow path (from the right side to the left side in FIG. 21, from the lower side to the upper side in FIG. 22), and ink guides 204 and ejection electrodes 206 are provided on the convex portions 228. Also, concave portions 226 having a predetermined depth are formed outside the ejection electrodes 206 in the direction orthogonal to the ink flow path. That is, ejection portions adjacent to each other in the direction orthogonal to the ink flow path are formed on the same convex portion 228 and the concave portions 226 are formed between ejection portions adjacent to each other in a direction in which the ink flows.

It should be noted here that in this embodiment, the ejection electrodes 206 and electrode drawing portions 208 are provided below the ink guides 204, thereby reducing the areas of the convex portions 228 and increasing the areas of the concave portions 226 as compared with the embodiment shown in FIG. 5 where the ejection electrodes 206 and the electrode drawing portions 208 are provided outside the ink guides 204.

With this construction, the convex portions 228 function as leading weirs, so it becomes possible to lead the ink in an ink guide 204 tip end direction and supply the ink to the tip end portions of the ink guides 204 with efficiency.

Also, the concave portions 226 are provided, thereby increasing the area of the ink flow path 44. As a result, the amount of the ink flowing in the ink flow path 44 increases and the ink can be supplied to the tip end portions of the ink guides 204 with efficiency.

Here, it is possible to say that the convex portions 228 and the concave portions 226 provided for the head substrate 224 of the ink jet head 222 of the ink jet recording apparatus 220 shown in FIGS. 21 and 22 have the same constructions as the convex portions 94 and the concave portions 96 provided for the head substrate 92 of the ink jet head 91 of the ink jet recording apparatus 90 shown in FIGS. 5 and 6 except for the sizes of the convex portions and the concave portions and constructions of the ink guides, the ejection electrodes, and the electrode drawing portions, so the convex portions 228 and the concave portions 226 have the same functions and effects as the convex portions 94 and the concave portions 96. Therefore, the detailed description of the convex portions 228 and the concave portions 226 will be omitted.

Hereinafter, an ink jet head production method according to an embodiment of a liquid ejection head production method according to a sixth aspect of the present invention will be described with reference to FIGS. 23A to 23H.

Here, only one ejection portion is illustrated in FIGS. 23A to 23H, although it is certainly possible to produce two-dimensionally disposed ejection portions at the same time using the production method in this embodiment.

In this embodiment, a glass substrate 232 is used as an example of an electrical insulating substrate serving as a head substrate.

Figure 23A:
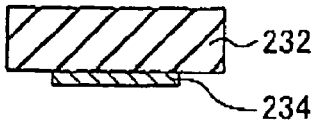
FIGS. 23A to 23J are each an outline diagram illustrating yet another embodiment of the liquid ejection head production method according to the present invention.

First, although not illustrated, a metallic film is evaporated onto the glass substrate 232, a mask corresponding to the electrode pattern of a wiring portion is produced on the metallic film with a lithography method or the like, and the metallic film is etched using the mask, thereby forming an electrode 234 serving as the wiring portion for the glass substrate 232 as shown in FIG. 23A. Here, a method for evaporating the metallic film is not specifically limited and it is sufficient that the metallic film is evaporated using a conventionally known technique such as sputtering or CVD.

Figure 23B:
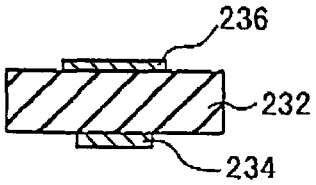

Next, a metallic film is evaporated onto a surface opposite to a surface of the glass substrate 232 on which the electrode 234 has been formed, and a mask corresponding to the electrode pattern of an ejection electrode is produced on the metallic film using a lithography method or the like. Then, the metallic film is etched using the produced mask as an etching mask, thereby forming a circular electrode 236 serving as the ejection electrode as shown in FIG. 23B.

Figure 23C:
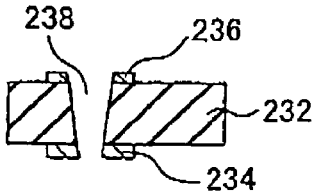

Next, as shown in FIG. 23C, a through-hole 238 that is 100 μm in diameter for example is formed in the glass substrate 232 so that the electrode 234 and the electrode 236 form some portions of the inner wall surface of the through-hole 238.

By thus forming the through-hole 238, the electrode 234 and the electrode 236 are partially exposed to the side surface of the through-hole 238.

It is sufficient that the through-hole 238 is formed using a conventionally known technique such as sand blasting or laser beam machining.

Figure 23D:
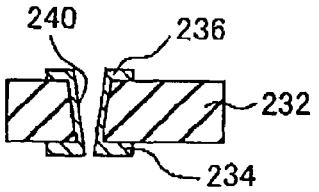

Next, as shown in FIG. 23D, for continuity between the electrode 234 and the electrode 236 on both surfaces of the glass substrate 232, a metallic film is evaporated onto the side surface of the through-hole 238, thereby forming an electrode 240 on the side surface of the through-hole 238. At this time, in order to prevent the metallic film from being evaporated onto portions other than the side surface of the through-hole 238, a resist layer serving as a mask may be formed in portions where the metallic film is not to be evaporated.

Figure 23E:
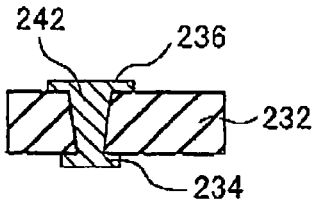

Then, a metal is filled into the through-hole 238 by performing plating such as electroplating. As a result, as shown in FIG. 23E, a plated portion 242 serving as an electrode drawing portion is formed in the through-hole 238 and the plated portion 242 also covers the portion corresponding to the electrode 236.

Here, it is possible to use various metals as the metal used to perform the plating and it is particularly preferable to use a metal, such as copper, nickel, or solder, which will never be corroded even through contact with ink.

Also, the punching step described above, that is, the step for forming the through-hole in the glass substrate and the metal filling step, that is, the step for filling the metal into the through-hole may be performed after a joining step to be described next.

Next, the electrode 236 and a surface of an Si substrate 244 are joined to each other. As a method of joining the electrode 236 and the Si substrate 244 to each other, it is possible to use various methods, such as joining through eutectic reaction between the electrode 236 and the Si substrate 244, joining through mutual diffusion between a metallic film formed for the Si substrate 244 and the metallic film formed for the glass substrate 232, and soldering.

Here, the electrode 236 and the Si substrate 244 are joined to each other through the eutectic reaction. It is possible to adopt, for instance, a method with which the electrode 236 is formed using Au, and AuSi is formed by causing Si of the Si substrate 244 and Au of the electrode 236 to react with each other through heating of portions to be joined to each other to around 400° C.

Also, in the case of the joining through the mutual diffusion between the metallic films, it is, for instance, possible to use a method with which the electrode 236 is formed using Au, an AuSn film is formed for the Si substrate 244 as the metallic film, and the electrode 236 and the Si substrate 244 are joined to each other by diffusing Sn through heating of portions to be joined to each other to around 300° C.

Figure 23F:
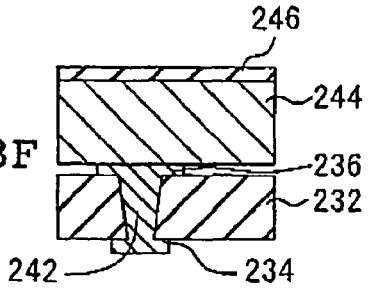

Here, as shown in FIG. 23F, an oxide film 246 is formed on a surface of the Si substrate 244 that is not joined to the electrode 236. The oxide film 246 is generally formed through film formation based on sputtering or CVD of $SiO_2$ or through oxidation before joining with the electrode 236. Also, the surface of the Si substrate 244 on which the oxide film has been formed is a <100> crystalline plane.

Figure 23G:
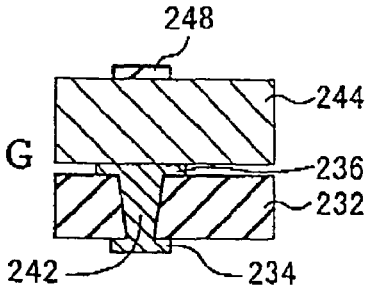

Next, a square resist pattern whose sides coincide with the <110> and <1-10> crystal orientations of the Si substrate 244, is formed on the oxide film 246 using a lithography method or the like at a position corresponding to arrangement of an ink guide. Following this, the oxide film 246 is etched using the resist pattern as an etching mask. As a result, as shown in FIG. 23G, the oxide film 246 becomes a mask 248 having a shape corresponding to the shape of the square resist pattern, that is, a square shape whose sides coincide with the <110> and <1-10> crystal orientations of the Si substrate 244.

Figure 23H:
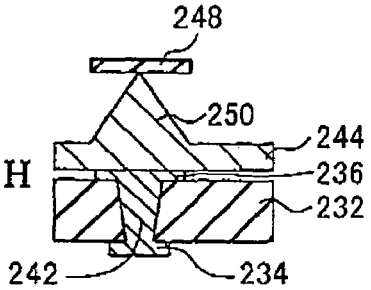

Next, the Si substrate 244 is immersed in, for instance, a 34 wt % aqueous solution of KOH heated to 70° C. and anisotropic etching of the Si substrate is performed. In this etching Step, the Si substrate 244 is anisotropically etched using the square mask 248 as an etching mask. During this etching, undercut progresses from the square portion of the mask 248 and the etching is performed until the mask 248 is separated from the surface of the Si substrate 244. In this manner, as shown in FIG. 23H, a pyramidal structural member 250 that is formed by inclined surfaces of a high-order polyhedron and serves as the tip end portion of the ink guide having a sharpened tip end with a tip end angle of 60° or less and/or a radius of curvature of 4 μm or less is formed for a part of the Si substrate 244. Here, after the anisotropic etching of the Si substrate 244 is performed, the Si substrate 244 is left by a predetermined thickness. The pyramidal structural member 250 is therefore formed on the Si substrate 244 having the predetermined thickness.

Figure 23I:
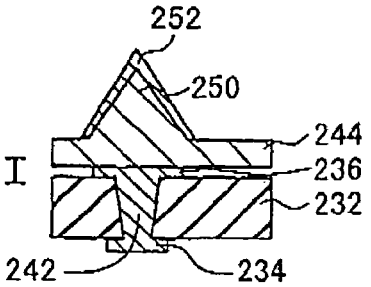

Next, as shown in FIG. 23I, a mask 252 resistant to Si etching is formed using $SiO_2$, a metal, or the like for the pyramidal structural member 250.

Figure 23J:
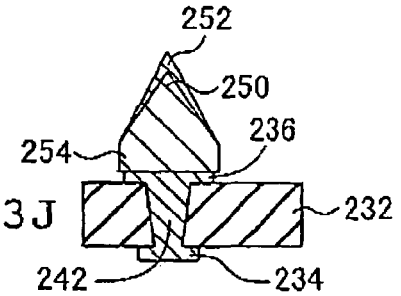

Next, the Si substrate 244 is etched through Deep-RIE using the mask 252 as an etching mask, thereby forming on a surface of the glass substrate 100 a columnar structural member 254 having the pyramidal structural member 250 in its tip end portion and serving as a base portion of the ink guide on a surface of the electrode 236 as shown in FIG. 23J.

With the method described above, it is possible to produce a head substrate structural body including the ejection electrode, the ink guide which is provided on the ejection electrode and whose tip end is sharply pointed, the electrode drawing portion that is provided below the ejection electrode so as to pass through the head substrate and establishes connection with voltage application means for applying a voltage, and the wiring portion provided on a surface opposite to the surface on which the ejection electrode of the head substrate has been arranged.

Even in this case, it is possible to produce an ink jet head through assembling where a through-hole substrate including through-holes at positions corresponding to ejection portions is further placed at a position spaced apart from the head substrate of the head-substrate-side structural body produced in the manner described above by a predetermined distance.

In this embodiment, the pyramidal structural member serving as the ink guide is produced using the Si substrate. The present invention is not limited to this and it is sufficient that a single crystal substrate made of GaAs, InP, or the like on which anisotropic etching can be performed is used.

Here, as a matter of course, in order to form the electrode and the pyramidal structural member at precise positions, alignment marks may be formed at predetermined positions of the glass substrate, the Si substrate, and the like and alignment may be performed using the formed marks.

By thus manufacturing a liquid ejection head using, for instance, lithography and etching of a semiconductor manufacturing method, an ink guide and an ejection electrode having high reliability and high accuracy can be produced. As a result, an ink jet head can be produced at a low cost.

Also, by using the production method described above, it is also possible to produce with high accuracy an ink guide whose tip end is sharply pointed.

Next, another embodiment of the liquid ejection head production method according to the sixth aspect of the present invention will be described with reference to FIGS. 24A to 24C.

It should be noted here that the production method in this embodiment is the same as that in the embodiment described above based on FIGS. 23A to 23H except the ink guide production method. Different points will be mainly described in the following explanation.

First, like in the case of the production method described based on FIGS. 23A to 23H, an electrode 234 serving as a wiring portion is formed for a glass substrate 232. An electrode 236 serving as an ejection electrode is formed on a surface opposite to the surface of the glass substrate 232 on which the electrode 234 has been formed, at a position corresponding to arrangement of an ink guide. A through-hole is formed so that the electrode 236 and the electrode 234 constitute some portions of the inner wall of the through-hole. A metallic film is evaporated onto the side surface of the through-hole, and a plated portion 242 serving as an electrode drawing portion is produced by performing plating so as to fill the through-hole.

Figure 24A:
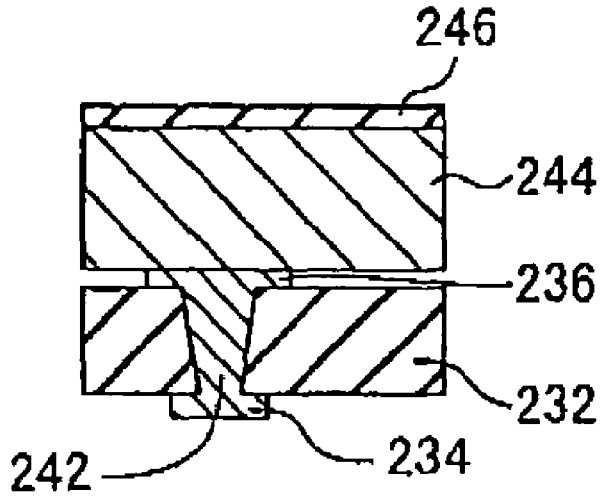
FIGS. 24A to 24C are each an outline diagram illustrating still yet another embodiment of the liquid ejection head production method according to the present invention.

Then, by joining the electrode 236 on the glass substrate 232 and an Si substrate 244 with each other through eutectic reaction, mutual diffusion between metallic films, soldering, or the like, a product shown in FIG. 24A is obtained which has the same structure as the product shown in FIG. 23F.

Figure 24B:
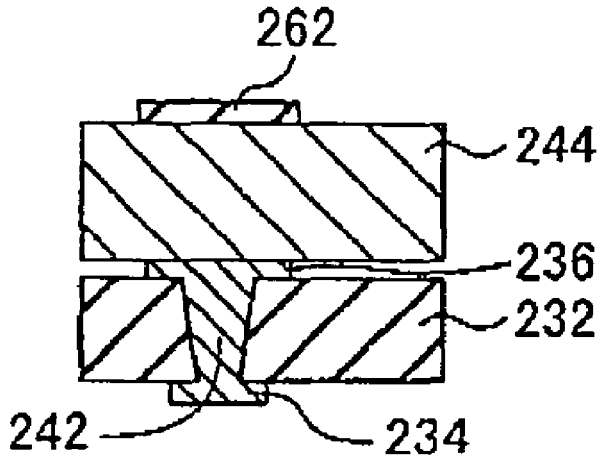

Next, as shown in FIG. 24B, a mask 262 is formed at a position corresponding to arrangement of the ink guide.

Figure 24C:
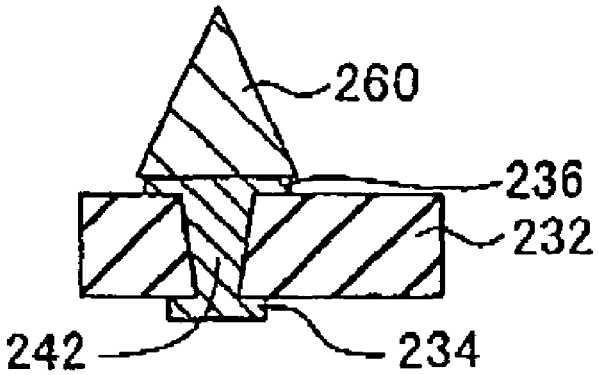

Next, by performing anisotropic etching of the Si substrate 244 using the mask 262 as an etching mask, a pyramidal structural member 260 shown in FIG. 24C is formed which serves as an ink guide whose tip end is sharply pointed.

Even with the method described above, it is possible to produce a head substrate including the ejection electrode, the ink guide which is provided on the ejection electrode and whose tip end is sharply pointed, the electrode drawing portion provided below the ejection electrode so as to pass through the head substrate and establishing connection with voltage application means for applying a voltage, and the wiring portion provided on a surface opposite to the surface on which the ejection electrode of the head substrate has been arranged.

Even in this case, in completely the same manner, it is possible to produce an ink jet head through assembling where a through-hole substrate including through-holes at positions corresponding to ejection portions is further placed at a position spaced apart from the head substrate of the head-substrate-side structural body produced in the manner described above by a predetermined distance.

Adjusting the shapes of the masks, etchant, and the like, makes it possible to eliminate limitation to an ink guide including a tip end portion having a pyramidal structure and a base portion having a columnar structure and produce ink guides having various shapes such as an ink guide having a pyramidal structure.

The liquid ejection head and the production method thereof according to the present invention have been described in detail above. The present invention is not limited to the embodiments described above and it is certainly possible to make various changes and modifications without departing from the gist of the present invention.

What is claimed is:

1. A liquid ejection head that ejects droplets by causing an electrostatic force to act on a solution in which charged particles are dispersed, comprising:

a through-hole substrate in which at least one through-hole, through which said droplets are ejected, is formed;

an electrical insulating head substrate arranged to be spaced apart from said through-hole substrate by a predetermined distance, wherein a gap between said through-hole substrate and said electrical insulating head substrate being defined as a flow path of said solution;

at least one solution guide, each being mounted at each position corresponding to each through-hole on a first surface of said electrical insulating head substrate on a through-hole substrate side, a tip end portion of each solution guide passing through and protruding from each through-hole, and each solution guide gradually narrowing toward said tip end portion;

at least one control electrode, each being provided on said first surface of said electrical insulating head substrate so that a center of each control electrode approximately coincides with each solution guide and causing said electrostatic force to act on said solution, at least one electrode drawing portion, each being connected to each control electrode and passing through said electrical insulating head substrate from said first surface to a second surface on a back side opposite to said first surface; and a wiring portion provided on said second surface of said electrical insulating head substrate and connecting to each other said at least one electrode drawing portion and voltage application means for applying a voltage to said at least one control electrode.

2. The liquid ejection head according to claim 1, wherein each control electrode is provided on said first surface of said electrical insulating head substrate around a base portion of each solution guide so as to surround each solution guide and be spaced apart from each solution guide by a predetermined distance.

3. The liquid ejection head according to claim 1, wherein said tip end portion of said at least one solution guide has at least one of a tip end angle of 60° or less and a radius of curvature of 4 μm or less.

4. The liquid ejection head according to claim 1, wherein said at least one solution guide is a metal-made solution guide having a sharply pointed tip end portion.

5. The liquid ejection head according to claim 4, wherein said at least one solution guide is insulated.

6. The liquid ejection head according to claim 5, wherein said at least one solution guide is mounted onto an insulation layer attached onto a metallic layer attached onto said first surface of said electrical insulating head substrate.

7. The liquid ejection head according to claim 4, wherein said tip end portion of said at least one solution guide has at least one of a tip end angle of 120° or less and a radius of curvature of 4 μm or less.

8. The liquid ejection head according to claim 1, wherein said at least one control electrode is partially removed on an upstream side of said flow path from which said solution is supplied.

9. The liquid ejection head according to claim 1, wherein said at least one electrode drawing portion is provided on a downstream side of said flow path that is a side opposite to a solution supply side of said flow path with respect to said at least one solution guide.

10. The liquid ejection head according to claim 1, wherein each control electrode is provided at each position corresponding to each through-hole on said first surface of said electrical insulating head substrate and each solution guide is mounted onto each control electrode.

11. The liquid ejection head according to claim 10, wherein said tip end portion of said at least one solution guide has at least one of a tip end angle of 60° or less and a radius of curvature of 4 μm or less.

12. The liquid ejection head according to claim 10, wherein said at least one solution guide has conductivity.

13. The liquid ejection head according to claim 10, wherein said at least one solution guide is made of a semiconductor whose electric conductivity is in a range of from $10^{-2}$ S/m to $10^{6}$ S/m.

14. The liquid ejection head according to claim 10, wherein said at least one solution guide is made of Si.

15. The liquid ejection head according to claim 1, wherein said through-hole substrate is insulative.

16. The liquid ejection head according to claim 15, further comprising:

a shield electrode with which said through-hole substrate is provided.

17. The liquid ejection head according to claim 1, wherein a surface of said through-hole substrate on a side opposite to an electrical insulating head substrate side is liquid-repellent.

18. The liquid ejection head according to claim 1, further comprising:

at least one flow path weir arranged for said electrical insulating head substrate outside said at least one solution guide, said at least one control electrode and said at least one electrode drawing portion.

* * * * *

UNITED STATES PATENT AND TRADEMARK OFFICE

CERTIFICATE OF CORRECTION

PATENT NO. : 7,296,879 B2
APPLICATION NO. : 11/061575
DATED : November 20, 2007
INVENTOR(S) : Toshiaki Fukunaga and Yasuhisa Kaneko It is certified that error appears in the above-identified patent and that said Letters Patent is hereby corrected as shown below:

On the title page, item [30] Foreign Application Data
Change "Feb. 25, 2004- (JP)---2004-049344" to read:
--Feb. 20, 2004- (JP)2004-044416--.

Signed and Sealed this

Sixth Day of May, 2008

JON W. DUDAS
*Director of the United States Patent and Trademark Office*

UNITED STATES PATENT AND TRADEMARK OFFICE

CERTIFICATE OF CORRECTION

PATENT NO. : 7,296,879 B2
APPLICATION NO. : 11/061575
DATED : November 20, 2007
INVENTOR(S) : Toshiaki Fukunaga and Yasuhisa Kaneko It is certified that error appears in the above-identified patent and that said Letters Patent is hereby corrected as shown below:

On the title page, item [30] Foreign Application Data
Should read --Feb. 25, 2004- (JP)---2004-049344
Feb. 26, 2004- (JP)---2004-051774
Feb. 20, 2004- (JP)---2004-044416--.

This certificate supersedes the Certificate of Correction issued May 6, 2008.

Signed and Sealed this

Twelfth Day of August, 2008

JON W. DUDAS
*Director of the United States Patent and Trademark Office*